US012420898B2

(12) United States Patent
De Turckheim

(10) Patent No.: US 12,420,898 B2
(45) Date of Patent: Sep. 23, 2025

(54) CAMBERING DEVICE FOR PROFILED SAIL

(71) Applicants: Philippe Marcovich, Lamorlaye (FR); Hugues De Turckheim, Saint Andre les Alpes (FR)

(72) Inventor: Hugues De Turckheim, Saint Andre les Alpes (FR)

(73) Assignees: Philippe Marcovich, Lamorlaye (FR); Hugues De Turckhem, Saint Andre les Alpes (FR)

( * ) Notice: Subject to any disclaimer, the term of this patent is extended or adjusted under 35 U.S.C. 154(b) by 584 days.

(21) Appl. No.: 17/794,471

(22) PCT Filed: Jan. 6, 2021

(86) PCT No.: PCT/FR2021/050013
§ 371 (c)(1),
(2) Date: Jul. 21, 2022

(87) PCT Pub. No.: WO2021/148734
PCT Pub. Date: Jul. 29, 2021

(65) Prior Publication Data

US 2023/0067148 A1 Mar. 2, 2023

(30) Foreign Application Priority Data

Jan. 22, 2020 (FR) ..... 20 00594

(51) Int. Cl.
*B63H 9/061* (2020.01)
*B63H 9/067* (2020.01)
*B63H 9/10* (2006.01)

(52) U.S. Cl.
CPC ..... *B63H 9/061* (2020.02); *B63H 9/067* (2020.02); *B63H 9/10* (2013.01)

(58) Field of Classification Search
CPC ..... B63H 9/00; B63H 9/06; B63H 9/0607; B63H 9/061; B63H 9/067; B63H 9/10
(Continued)

(56) References Cited

U.S. PATENT DOCUMENTS 2,650,047 A * 8/1953 Stoner ..... B64C 3/48 244/214
4,624,203 A * 11/1986 Ferguson ..... B63H 9/061 114/39.31

(Continued)

FOREIGN PATENT DOCUMENTS

| | | |
|---|---|---|
| DE | 10 2014 103999 | 9/2015 |
| WO | 96/11135 | 4/1996 |
| WO | 2015/048854 | 4/2015 |
| WO | 2017/202858 | 11/2017 |

OTHER PUBLICATIONS

International Search Report for PCT/FR2021/050013, dated May 4, 2021, with English translation (6 pages).

(Continued)

*Primary Examiner* — Daniel V Venne
(74) *Attorney, Agent, or Firm* — NIXON & VANDERHYE

(57) ABSTRACT

Cambering device for a profiled sail including: —an elastically deformable semi-rigid structure, including: —two length sections, extending one in front of the other, forming respectively a first length section secured to a first surface of the profiled sail, and a second length section secured to a second surface of the profiled sail, —a U-shaped connecting section, connecting together the two length sections terminating at the trailing edge by a tensioning of one of the two free ends, —a spacing system configured for working in compression and in tension, for maintaining a separation (Continued)

between the two length sections, —the action of the actuator, connecting together the two free ends of the semi-rigid structure.

26 Claims, 15 Drawing Sheets

(58) Field of Classification Search
USPC ..... 114/102.1, 102.12, 102.13, 102.15, 114/102.16, 102.18, 102.22, 102.24, 114/102.25, 102.26, 102.27, 102.29, 114/39.21, 39.31
See application file for complete search history.

(56) References Cited

U.S. PATENT DOCUMENTS

| | | | | |
|---|---|---|---|---|
| 5,603,276 | A * | 2/1997 | Julien | B63H 9/061 114/39.21 |
| 9,199,709 | B2 * | 12/2015 | De Turckheim | B63H 9/061 |
| 9,975,618 | B2 * | 5/2018 | De Turckheim | B63H 9/061 |
| 10,953,969 | B2 * | 3/2021 | De Turckheim | B63H 9/065 |

OTHER PUBLICATIONS

Written Opinion of the ISA for PCT/FR2021/050013, dated May 4, 2021 (7 pages).

* cited by examiner

CAMBERING DEVICE FOR PROFILED SAIL

CROSS-REFERENCE TO RELATED APPLICATIONS

This application is the U.S. national phase of International Application No. PCT/FR2021/050013 filed Jan. 6, 2021 which designated the U.S. and claims priority to FR 20 00594 filed Jan. 22, 2020, the entire contents of each of which are hereby incorporated by reference.

BACKGROUND OF THE INVENTION

Field of the Invention

The present disclosure relates to a cambering device for a profiled sail, as well as an assembly (in particular rigging) comprising a profiled sail and a plurality of cambering devices according to the present disclosure.

The present disclosure relates to the field of riggings, and more particular profiled sails, also referred to as "wing sails" or "thick sails" by a person skilled in the art, and more particularly mechanisms internal to the sail making it possible to change the profile of the sail.

Description of the Related Art

A frame device for a profiled sail is known from the document EP2718179B1, disposed internally to the thick sail and making it possible to modify its profile for sailing.

In a notable manner, this device includes a plurality of frame elements adjustable with respect to one another, and at least one frame element of which has a first contour attributed to a first surface of the profiled sail and a second contour attributed to the second profiled-sail surface. The frame device is adjustable, according to at least two operating positions, making it possible to change the profile of the sail for sailing. The various positions of the frame elements are obtained by means of ropes, visible in FIG. 4 of the document EP2718179B1, which each make it possible to move the device into one or other of the two operating positions.

According to the findings of the inventor, such a rigging does however have the following drawbacks:

- great fragility: the frame elements, which are rigid, are "hard" elements internal to the profiled sail that are fragile per se, but also liable to degrade the sail, in particular during manoeuvres;
- imprecision in control: the control ropes allow a remote actuation of the position of the frame elements in the two operating positionings, but suffer a variation in length of their path when the assembly deforms under the pressure of the wind, giving rise to imprecision in control;
- a risk of tangling: these control ropes, which extend over the height of the rigging, along the direction of the mast, have a significant risk of tangling with each other, or with other elements of the rigging, for example when the sail is hauled down.

A cambering device including an elastically deformable semi-rigid structure, including two length sections, extending one in front of the other, forming respectively a first length section secured to a first surface of the profiled sail and a second length section secured to a second surface of the profiled sail, is however known from the document WO2017/202858 A1 (or US2020/0189707),

- a U-shaped connecting section, connecting together while extending them the first length section and the second length section at the leading edge of the profiled sail, the two length sections terminating at the trailing edge of the sail in two free ends,
- a spacing system, comprising at least one spacer connecting together the first length section and the second length section, configured to work in compression and in tension, to maintain a gap between the two length sections.

The document WO 2017/202858 A1 also discloses actuation means that comprise a control link connecting together, firstly the two free ends of the semi-rigid structure, and secondly the U-shaped connecting section, configured to camber the first length section and the second length section of the semi-rigid structure by putting the two free ends under tension with the U-shaped connecting section of the semi-rigid structure, and generating an offset between the two free ends.

In particular, the visible part of the control link, referenced 210 in FIG. 1 of the document WO 2017/202858 A1, extends from the U-shaped connecting section at the leading edge of the sail, outside the semi-rigid structure as far as exterior angular member of a first force transmission element referenced 248, at the free end of the second length section, and then as far as a second force transmission element reference 252 forming an angular member, secured to an intermediate portion of the second length section, before extending inside the semi-rigid structure, and connecting a first force transmission element 246 secured to the free end of the first length section.

According to the findings of the inventor, the control link referenced 210 is an entirely passive component that requires being tensioned to camber the semi-rigid structure and which is therefore extended, in its non-visible part, downwards as far as the foot of the mast as far as an actuator enabling it to be tensioned.

According to the findings of the inventor, such a rigging according to WO 2017/202858, if it is of less fragility than the one disclosed by the document EP2718179B1, does however still have the following drawbacks:

- imprecision in control: the control ropes (in particular the control link) allow a remote actuation of the cambering of the semi-rigid structure, but suffer a variation in length of their path when the assembly deforms under the pressure of the wind, giving rise to imprecision in control;
- a risk of tangling: these control ropes, which extend over the height of the rigging, along the direction of the mast, have a significant risk of tangling with each other, or with other elements of the rigging, for example when the sail is hauled down.

SUMMARY OF THE INVENTION

The present disclosure improves the situation, in whole or in part.

A cambering device for a profiled sail is proposed, comprising:

- an elastically-deformable semi-rigid structure, including:
  - two length sections, extending one in front of the other, respectively forming a first length section secured to a first surface of the profiled sail, and a second length section secured to a second surface of the profiled sail,
  - a U-shaped connecting section, connecting together while extending them the first length section and the second length section at the leading edge of the profiled sail, the two length sections terminating at the trailing edge of the sail in two free ends, optionally, a spacing system, comprising at least one spacer connecting together the first length section and the second length section, configured for working in compression and in tension, to maintain a gap between the two length sections.

The cambering device also comprises actuation means connecting together firstly the two free ends of the semi-rigid structure and secondly the U-shaped connecting section, configured to camber the first length section and the second length section of the semi-rigid structure by tensioning the two free ends with the U-shaped connecting section of the semi-rigid structure, and generating an offset between the two free ends, or alternatively, actuation means connecting together firstly at least one of the two free ends and secondly the U-shaped connecting section, configured for cambering the first length section and the second length section of the semi-rigid structure by tensioning one of the two free ends with the U-shaped connecting section of the semi-rigid structure, and generating an offset between the two free ends.

In a notable manner, the actuation means comprise at least one actuator (active component) having two longitudinal ends, said actuator being retractable when activated, said at least one actuator extending along one of the two length sections of the semi-rigid structure, the first length section or the second length section, said actuator being internal to the semi-rigid structure, contained in a plane of the semi-rigid structure.

In a notable manner and preferably, said actuator, which is flexible, is an artificial muscle, contracting when supplied under pressure with a fluid, and relaxing when the pressure of the fluid decreases, said artificial muscle having an envelope receiving internally a balloon supplied with or discharged of fluid, the flexible envelope, in particular in the form of a braid retracting in length when its cross-section increases under the increase of the balloon supplied with fluid, and deploying in length when its cross-section decreases when the balloon is discharged of fluid.

In a notable manner also, one of the longitudinal ends of said at least one actuator is connected to one of the two free ends by an interior tendon while the other one of the two longitudinal ends of said at least one actuator is connected:

either to an anchoring point of the U-shaped connecting section, or to the other one of the two free ends via angular member secured to the U-shaped connecting section by an exterior tendon, the flexible exterior tendon passing outside the semi-rigid structure, and to the profiled sail between the angular member and respectively said other one of the two free ends.

The actuator (or actuators) that is the active component of the actuation means is (or are) advantageously internal to the profiled sail, integrated in the semi-rigid structure, and internal to the semi-rigid structure. The length of the control links (i.e. interior tendon and/or exterior tendon) is advantageously reduced compared with the prior art consisting of the document WO 2017/202858 A1, resulting in a control of the cambering with increased precision.

According to one embodiment, the semi-rigid structure has a profile having a symmetry plane, in a rest position of the semi-rigid structure, that is elastic, wherein the first length section and the second length section each have a convex profile, and wherein, in at least one cambered position of the semi-rigid structure under the action of the actuation means, said first length section has a concave profile when said second length section has a convex profile, or again said second length section has a concave profile when said first length section has a convex profile.

According to one embodiment, the actuation means are configured for cambering the semi-rigid structure, selectively:

in a first cambered position wherein said first length section has a concave profile when said second length section has a convex profile, in a second cambered position wherein said second length section has a concave profile when said first length section has a convex profile.

According to one embodiment, the actuation means comprise at least said actuator, extending along one of the two length sections of the structure, the first length section (or second length section), connected to the free end of the length section by a flexible tendon external to the semi-rigid structure, via the angular member secured to the U-shaped connecting section, and by the interior tendon that runs along the length section as far as a guide before connecting the free end of the other length section, the second length section (or first length section).

Said actuator is configured for retracting in an active state and pulling on the two free ends connected by the exterior tendon and the interior tendon, on the one hand, and on the angular member of the connecting section on the other hand, until the offset is created, the free end connected by the interior tendon advancing towards the leading edge with respect to the free end connected by the exterior tendon while causing the cambering of the semi-rigid structure, the acted-on exterior tendon separating from the length section, the first length section (or second length section), immediately adjacent to the exterior tendon, which then adopts a concave profile, and while the other length section, the second length section or first length section, adopts a convex profile.

According to an embodiment, said at least one actuator of the actuation means comprises:

a first actuator configured for cambering the structure in said first cambered position, extending along the first length section connected to the free end of the length section by the flexible exterior tendon, to the semi-rigid structure, via a first angular member secured to the U-shaped connecting section, and by the interior tendon that runs along the first length section as far as a guide secured to said first length section before connecting the free end of said second length section, the first actuator being configured, in an active state, for retracting and pulling on the two free ends connected by the exterior tendon and the interior tendon, on the one hand, and on the first angular member, on the other hand, until the offset is created, the free end connected by the interior tendon advancing towards the leading edge with respect to the free end connected by the exterior tendon while causing the cambering of the semi-rigid structure, the exterior tendon acted on separating from the first length section, which adopts a concave profile, the second length section adopting a convex profile in said first cambered position, a second actuator configured for cambering the structure in said second cambered position, extending along the second length section connected to the free end of the length section by a flexible exterior tendon, to the semi-rigid structure, via a second angular member secured to the U-shaped connecting section, and by the interior tendon that runs along the second length section as far as a guide secured to said second length section before connecting the free end of said first length section, the second actuator being configured, in an active state, for retracting and pulling on the two free ends connected by the exterior tendon and the interior tendon, on the one hand, and on the second angular member, on the other hand, until the offset is created, the free end connected by the interior tendon advancing towards the leading edge with respect to the free end connected by the exterior tendon while causing the cambering of the semi-rigid structure, the acted-on exterior tendon separating from the second length section, which adopts a concave profile, whereas the first length section adopts a convex profile in said second cambered position.

According to this embodiment, the exterior tendon extends from said angular member (the first angular member or the second angular member) outside the semi-rigid structure as far as said free end.

Alternatively, the exterior tendon extends between the angular member, the first angular member or the second angular member, and in the direction of said free end connected by the exterior tendon, outside the semi-rigid structure as far as a second guide carrying rollers, the second guide secured to the length section of the structure, the exterior tendon being located inside the semi-rigid structure between the second guide and said free end.

Alternatively, according to another embodiment, said at least one actuator of the actuation means comprises:

a first actuator for cambering the semi-rigid structure in said first cambered position, internal to the semi-rigid structure, extending along the first length section, one of the two longitudinal ends of which is connected to the free end of the second length section by an interior tendon that runs from one of the two longitudinal ends of the first actuator as far as a guide secured to the first length section, before connecting the free end of the second length section, while the other longitudinal end of the actuator is secured to a first anchoring point of the U-shaped connecting section, and wherein, the first actuator being configured, in an active state, to retract and to pull on the free end connected by the interior tendon, on the one hand, and on the first anchoring point on the other hand, until the offset is created, the end connected by the interior tendon advancing towards the leading edge with respect to the other free end while causing the cambering of the semi-rigid structure, the first length section adopting a concave profile, the second length section adopting a convex profile in said first cambered position, a second actuator for cambering the semi-rigid structure in said first cambered position, internal to the semi-rigid structure, extending along the second length section, one of the two longitudinal ends of which is connected to the free end of the first length section by the interior tendon that runs from one of the two longitudinal ends of the second actuator as far as a guide secured to the second length section, before connecting the free end of the first length section, while the other longitudinal end of the actuator is secured to a second anchoring point of the U-shaped section, and wherein the second actuator is configured, in an active state, for retracting and pulling on the free end connected by the interior tendon, on the one hand, and on the second anchoring point on the other hand, until the offset is created, the end connected by the interior tendon advancing towards the leading edge with respect to the other free end while causing the cambering of the semi-rigid structure, the second length section adopting a concave profile, the first length section adopting a convex profile in said second cambered position.

According to one embodiment, the cambering device comprises a control means configured for selectively:

activating the first actuator while keeping the second actuator non-activated to cause said first cambered position, activating the second actuator while keeping the first actuator non-activated to cause said second cambered position.

According to one embodiment, the cambering device comprises a flexible connecting system, joining together the first length section and the second length section, in an intermediate position between the two free ends and said spacing system; said flexible connecting system working under tension to maintain between them a separation between the two length sections. This flexible link system may include two flexible links, including a first flexible link secured by its two ends to the first length section, and a second flexible link secured by its two ends to the second length section, the two flexible links, the first flexible link and the second flexible link, being interlaced at a contact zone between the two flexible links, the contact zone between the two flexible links being configured for sliding along the flexible links during the cambering and the offsetting of the free ends, under the effect of the actuation means.

According to one embodiment, the spacing system may comprise a first spacer, connecting together the first length section and the second length section, as well as a second spacer, connecting together the first length section and the second length section, parallel to said first spacer.

According to one embodiment, the or each spacer of the spacing system is articulated in a pivot at its ends, respectively on the first length section along an axis perpendicular to the plane of the semi-rigid structure and on the second length section along an axis perpendicular to the plane of the semi-rigid structure, the or each spacer being configured for pivoting with respect to the two length sections, the first length section and the second length section, during cambering and the offsetting of the free ends; under the effect of the actuation means.

For this purpose, the cambering device may comprise articulated couplings, comprising a first part secured to the first length section (or to the second length section), and a second part receiving an end of the spacer, the second part being articulated on the first part on a pivot axis substantially perpendicular to the plane of the semi-rigid structure for pivoting with respect to the two length sections during cambering and offsetting of the free ends; under the effect of the actuation means.

According to one embodiment, the spacing system comprises a telescopic spacer connecting the first length section and the second length section, configured for deploying and retracting on a limited travel, working under compression in a retracted position of least separation, and working under tension a separated deployed position.

The semi-rigid structure comprising the connecting section and the two length sections, including the first length section and the second length section, can consist of a semi-rigid element in a single piece, kept curved for example by the spacing system; and where applicable said flexible connecting system, or even alternatively by one or more flexibles. The element in a single piece may be a rod or a blade, curved to form the first connecting section, the second connecting section and the U-shaped connecting section.

According to one embodiment, said cambering device can comprise means for attaching two edges of the profiled sail, at the trailing edge, including for each free end, a first support secured to the free end, having a bearing surface, and a second support mounted removably, and has a counter-bearing surface, as well as clamping means between the first support and the second support configured for gripping a sail edge between the bearing surface and the counter-bearing surface of the first support and second support.

According to another aspect, an assembly is proposed, for example rigging, comprising a profiled sail and a plurality of cambering devices according to the present disclosure and wherein the semi-rigid structure of each cambering device comprises the first length section secured to a first surface of the profiled sail, and the second length section secured to a second surface of the profiled sail, as well as the U-shaped connecting section, connecting together while extending them the first length section and the second length section at the leading edge of the profiled sail, the two length sections terminating at the trailing edge of the sail in two free ends.

According to this assembly, the actuation means comprise said at least one actuator, having the two longitudinal ends, said actuator being retractable when activated, said at least one actuator extending along one of the two length sections of the semi-rigid structure, the first length section and the second length section, said actuator being internal to the semi-rigid structure, contained in a plane of the semi-rigid structure.

Said flexible actuator may advantageously be said artificial muscle, contracting when supplied with pressure by a fluid, and relaxing when the pressure of the fluid decreases, said artificial muscle having an envelope receiving internally a balloon supplied with or discharged of the fluid, the flexible envelope, retracting in length when its cross-section increases under the increase of the balloon supplied with the fluid, and deploying in length when its cross-section decreases when the balloon is discharged of the fluid.

According to one embodiment, said profiled sail is carried by a mast extending internally to the semi-rigid structures of the cambering devices, through the interspace between said first length section and said second length section. When the spacing system comprising the first spacer, connecting together the first length section and the second length section, as well as the second spacer, connecting together the first length section and the second length section, parallel to said first spacer, said mast can extend internally to each semi-rigid structure at the interspace defined between the first spacer and the second spacer of the spacing system.

According to an advantageous embodiment of the assembly, the cambering devices comprise:

- said first actuator that extends along the first length section, between the two spacers, the first spacer and the second spacer,
- said second actuator that extends along the second length section, between the two spacers, the first spacer and the second spacer.

Advantageously, the first actuator and the second actuator, flexible components, are configured for damping and protecting the length sections—the first length section and the second length section, from the impacts resulting from the changes in bearing during changes in rack, tacking or gybing, the internal mast configured for changing bearing from the first length section against the second length section or vice-versa from the second length section against the first length section during changes in orientation and profile of the sail.

Alternatively, the spacing system may comprise a single spacer connecting together the first length section and the second length section, and in particular positioned in front or behind the mast.

Said assembly may in particular comprise a halyard (rope) for hoisting the profiled sail and the cambering devices up the mast, and hauling down the sail with its cambering devices when the halyard is released.

In particular, the profiled sail may be configured to be:

- hoisted up the mast, into a high position of the profiled sail, the cambering devices in positions separated from each other,
- hauled down the mast into the low position of the profiled sail, the cambering devices in positions close to each other.

Advantageously, the artificial muscles of the actuators of the plurality of cambering devices are supplied with fluid by one or more flexible elastic pipes, conformed in the form of a coil, extending in the direction of the height of the mast, the flexible elastic pipe or pipes being configured to deploy by separation of the turns of the coil in the high position of the profiled sail, and to retract by bringing together the turns of the coil, in the low position of the profiled sail.

Such an embodiment advantageously makes it possible to hoist the profiled sail or on the other hand to haul it down, without risk of tangling of the flexible pipes by virtue of the coil or coils. The supply pipes may for example extend in the hollow of the U-shaped connecting section, at the leading edge of the profiled sail.

According to one embodiment of said assembly, the artificial muscles of the actuators are supplied with fluid under pressure by the elastic pipe or pipes by a reserve of pressurised fluid, for example compressed air, located at the foot of the mast, preferably housed inside the mast, a tubular component.

The present disclosure also relates to a sail vehicle comprising an assembly, in particular rigging according to the present disclosure.

The present disclosure also relates to a wind turbine comprising an assembly, in particular rigging according to the present disclosure.

BRIEF DESCRIPTION OF THE DRAWINGS

Other features, details and advantages will emerge from the reading of the following detailed description and from the analysis of the accompanying drawings, among which.

a first actuator configured for cambering the semi-rigid structure in the first cambered position, said first actuator running along the first length section of the semi-rigid structure, in the form of an artificial muscle, one of the longitudinal ends of which is connected to the free end of the second length section by an interior tendon that runs along the first length section as far as a first guide secured to the first length section, before connecting the free end of the second length section, and the other of the free ends of which is connected to the free end of the first length section via a first angular member by an exterior tendon, which extends outside of the semi-rigid structure and of the first surface of the sail between the first angular member and a second guide carrying rollers secured to the first length section, the exterior tendon extending inside the semi-rigid structure between the second guide and the free end of the first length section, a second actuator configured for cambering the semi-rigid structure in the second cambered position, said second actuator running along the second length section of the semi-rigid structure, in the form of an artificial muscle, one of the longitudinal ends of which is connected to the free end of the first length section by an interior tendon that runs along the second length section as far as a second guide secured to the second length section, before connecting the free end of the first length section, and the other one of the free ends of which is connected to the free end of the second length section via a second angular member by an exterior tendon, which extends outside of the semi-rigid structure and of the second surface of the sail between the second angular member and a second guide carrying rollers secured to the second length section, the exterior tendon extending inside the semi-rigid structure between the second guide and the free end of the first length section.

Figure 14:
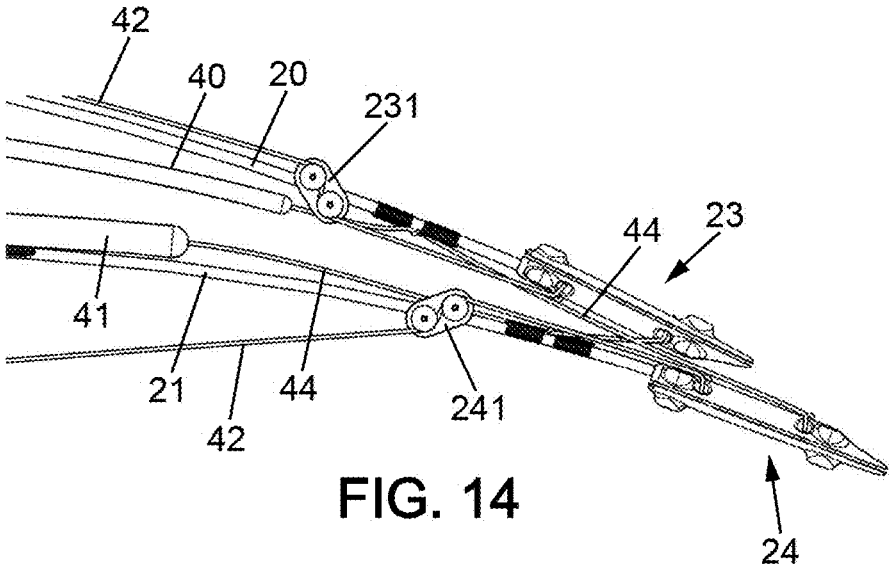

FIG. 14 Is a detail view of the second guides, carrying rollers providing the guidance of the exterior tendon from the outside towards the inside of the semi-rigid structure and of the profiled sail.

Figure 15:
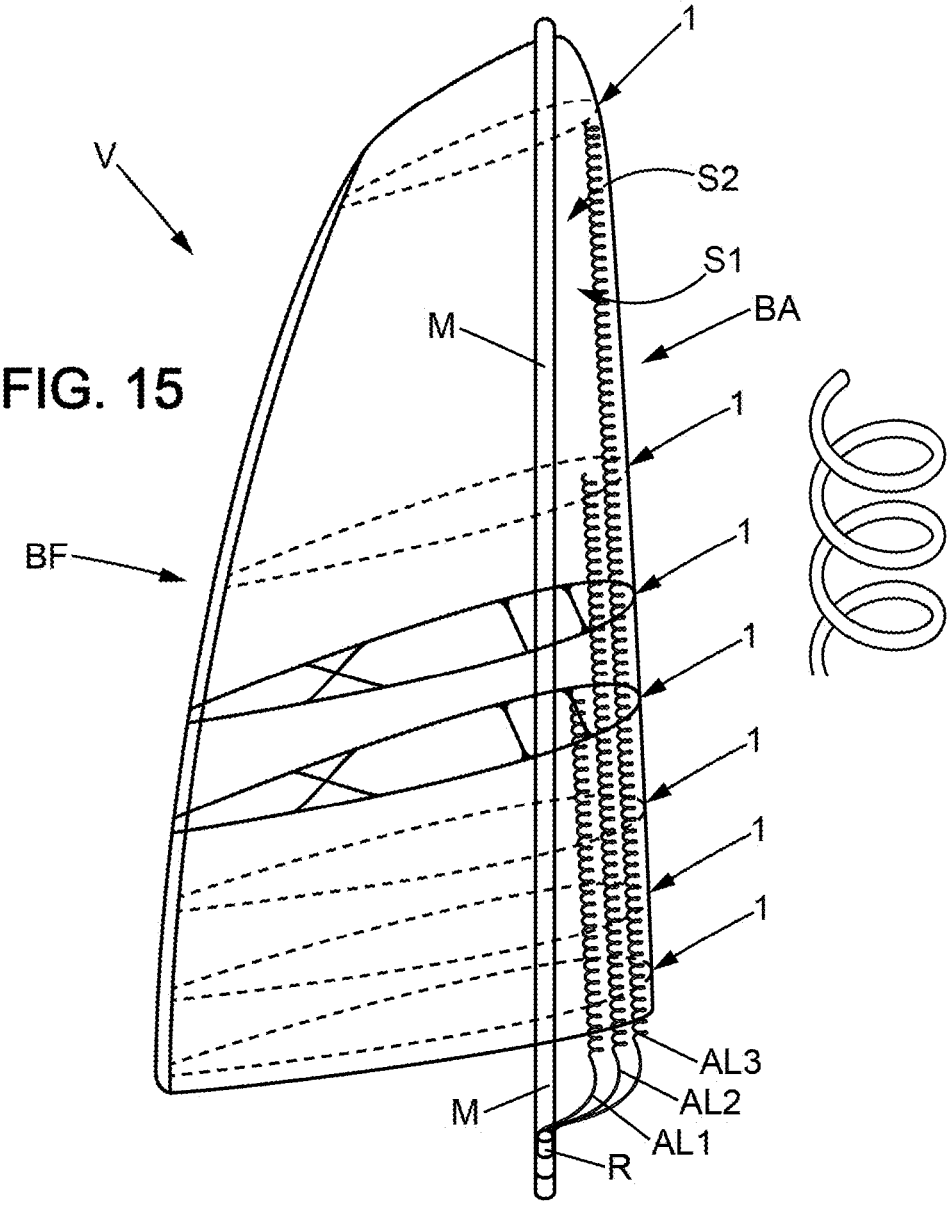

FIG. 15 is a view of the assembly comprising the profiled sail hoisted in the high position up the mast and the cambering devices in positions separated from each other, illustrating in a notable manner elastic flexible supply pipes for supplying pressurised fluid to the artificial muscles of the cambering devices, the elastic pipes conformed in a coil, the pipes deployed with separation of the turns of the coil.

Figure 16:
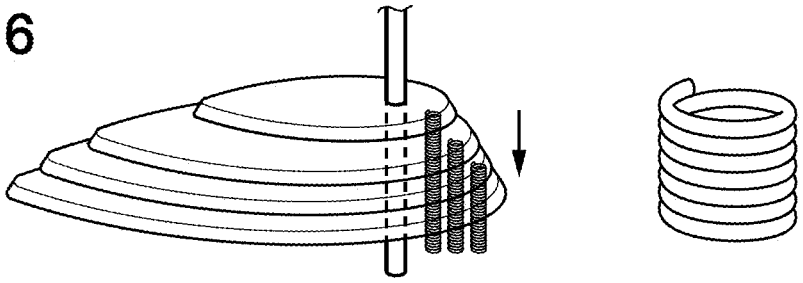

FIG. 16 is a view of the assembly in FIG. 15, once the profiled sail is hauled down in the low position on the mast, the cambering devices in close-together positions by comparison with the view in FIG. 15, the pipes retracted with the turns of the coil being brought together under the elasticity of the coil.

Figure 17A:
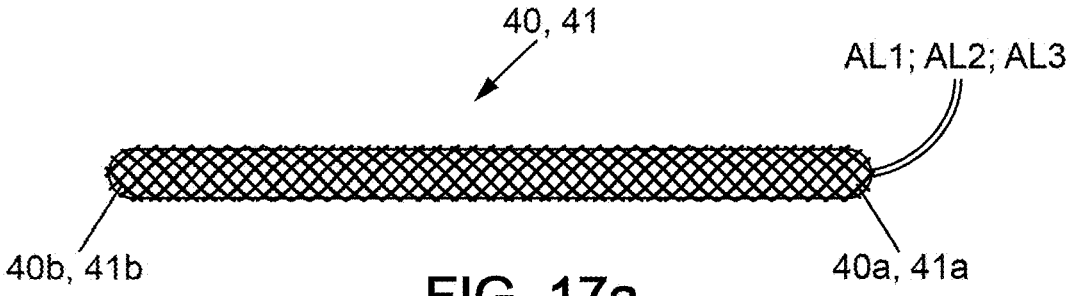

FIG. 17*a* is a schematic view of an artificial muscle in its non-activated position, namely discharged of the pressurised fluid.

Figure 17B:
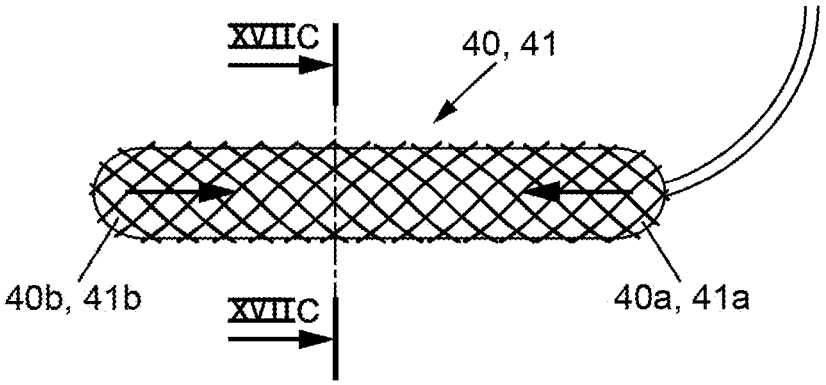

FIG. 17*b* is a schematic view of the artificial muscle in FIG. 17*a* in its activated position, namely supplied with the pressurised fluid, which causes an increase in its cross-section and the retraction in length of the actuator with its longitudinal ends being brought together.

Figure 17C:
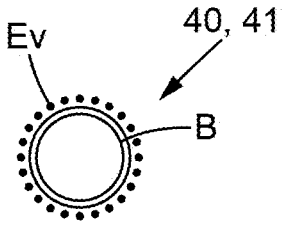

FIG. 17*c* is a cross-sectional view of FIG. 17*b*, illustrating in cross-section the envelope in the form of a braid, and the (fluidtight) balloon received inside the envelope supplied with pressurised fluid.

Figure 4:
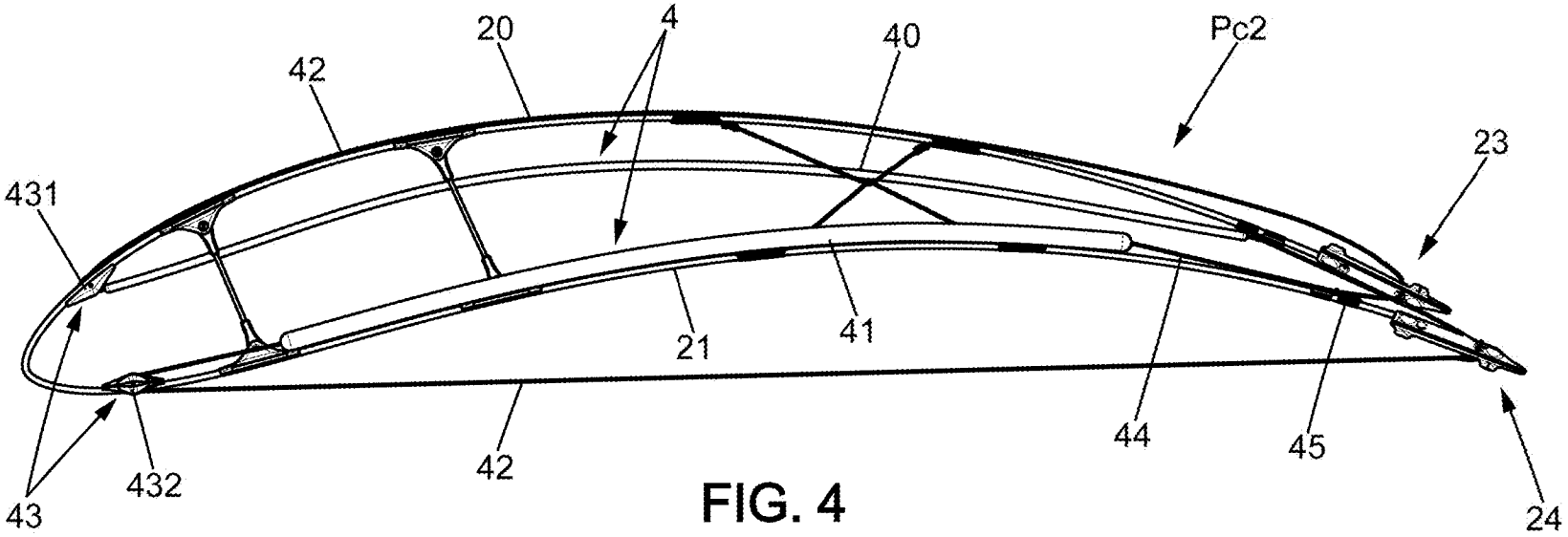
FIG. 4 is a view of the cambering device of FIG. 3, the actuation means fully illustrated, including the first actuator in the form of a pneumatic muscle running along the first length section in a deployed (non-activated) state, connected to the free end of the first section by an exterior tensioner via a first angular member, and connected to the free end of the second section by an interior tensioner, the actuation means also comprising a second actuator formed by a pneumatic muscle, in a retracted (activated) state connected to the free end of the second length section by an exterior tendon via a second angular member, and connected to the free end of the first length section by an interior tendon, the second actuator deforming the semi-rigid structure in a cambered position by a tensioning between the free ends on the one hand and the second angular member secured to the U-shaped connecting section on the other hand.
Figure 18A:
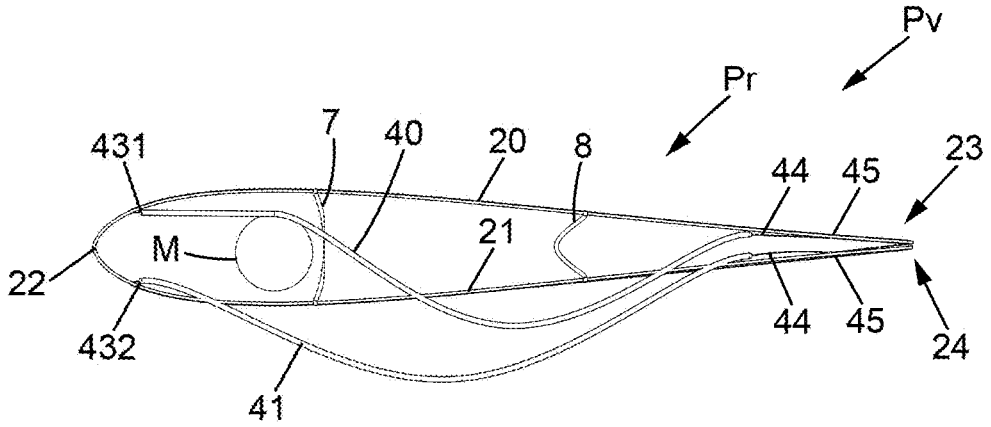

FIG. 18*a* is a view of a cambering device according to a third embodiment, differentiated from that of FIG. 4 by a simplified structure, the spacing system and the flexible connecting system visible in FIG. 4 being replaced by two flexible connections, and in the rest position.

Figure 18B:
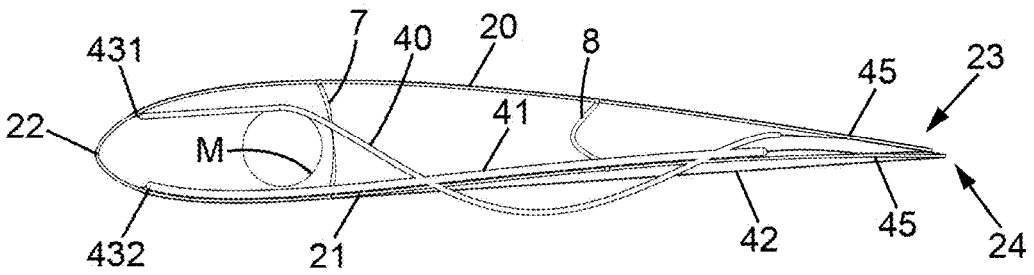

FIG. 18*b* is a view of the cambering device according to FIG. 18*a* in the second cambering position (3% cambering).

Figure 18C:
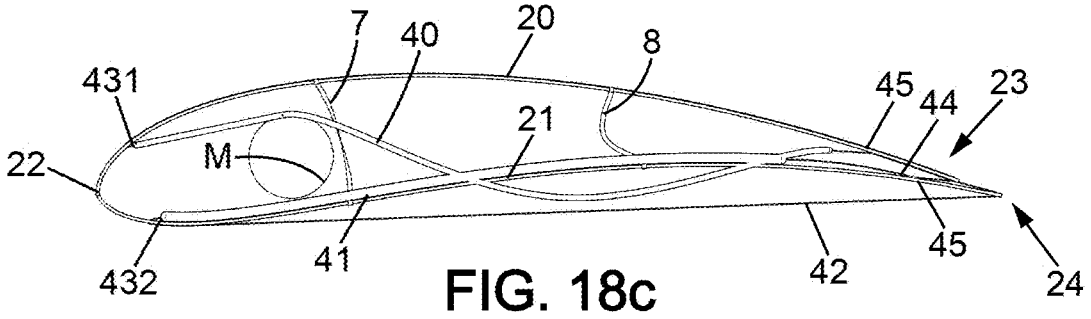

FIG. 18*c* is a view of the cambering device according to FIG. 18*a* in the second cambering position (9% cambering).

Figure 18D:
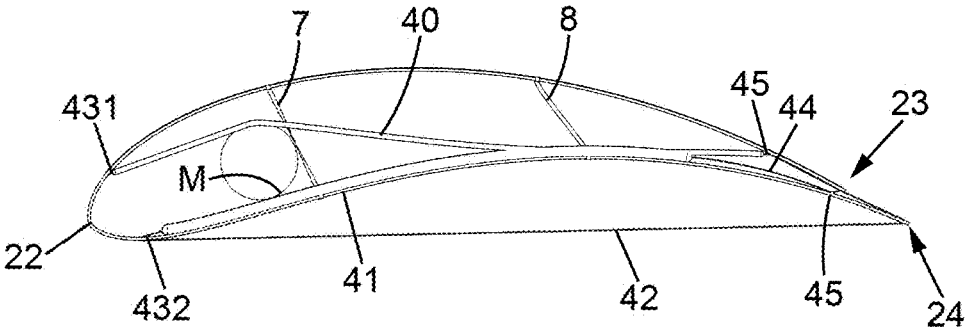

FIG. 18*d* is a view of the cambering device according to FIG. 18*a* in the second cambering position (15% cambering).

DESCRIPTION OF THE PREFERRED EMBODIMENTS

The drawings and the following description contain, essentially, elements of a certain character. They can therefore not only serve to best give an understanding of the present disclosure, but also contribute to the definition thereof, where applicable.

Thus the present disclosure relates to a cambering device 1 for a profiled sail V comprising:

- an elastically deformable semi-rigid structure 2, including:
  - two length sections, extending one in front of the other, forming respectively a first length section 20 secured to a first surface S1 of the profiled sail V, and a second length section 21 secured to a second surface S2 of the profiled sail V,
  - a U-shaped connecting section 22, connecting together while extending them the first length section 20 and the second length section 21 at the leading edge BA of the profiled sail, the two length sections terminating at the trailing edge BF of the sail in two free ends 23, 24,
- a spacing system 3, comprising at least one spacer connected together the first length section 20 and the second length section 21, configured for working in compression and tension, to maintain a gap between the two length sections 20, 21.

Figure 13:
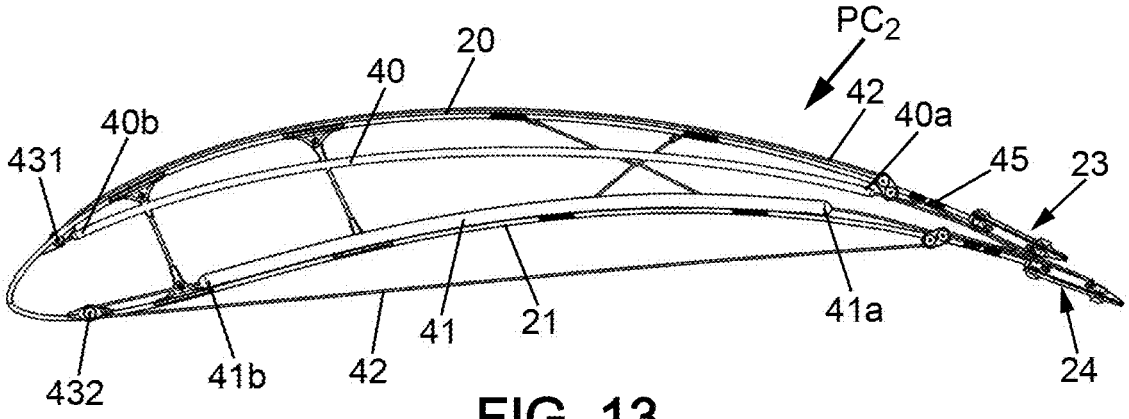
FIG. 13 Is a view of a cambering device according to a third embodiment in the second cambered position of the semi-rigid structure, comprising.

The cambering device 1 also comprises, according to a first possibility, illustrated in particular in FIG. 4, or in FIGS. 13 and 14): actuation means 4 connecting together on the one hand the two free ends 23, 24 of the semi-rigid structure and on the other hand the U-shaped connecting section 22, configured for cambering the first length section and the second length section of the semi-rigid structure by tensioning the two free ends 23, 24 with the U-shape connecting section 22 of the semi-rigid structure 2, and generating an offset d between the two free ends 23, 24.

Figure 11:
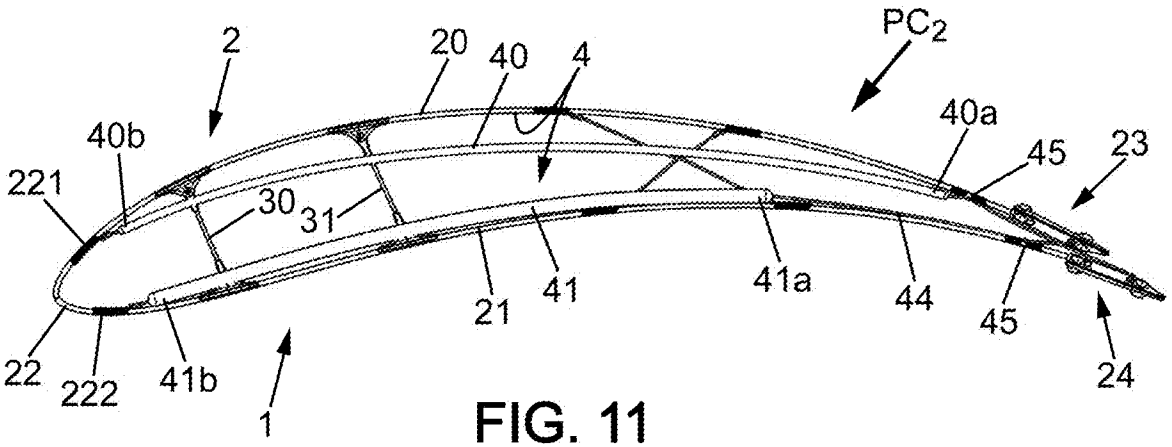
FIG. 11 is a view of a cambering device according to a second embodiment in the second cambered position of the semi-rigid structure, with firstly the presence of a first actuator configured for cambering the semi-rigid structure in the first cambered position, said actuator in the form of an artificial muscle running along the first length section of the semi-rigid structure, one of the longitudinal ends of which is connected to a first anchoring point secured to the U-shaped connecting section, and the other one of the longitudinal ends is connected to the free end of the second length section by an interior tendon that runs along the first length section as far as a guide secured to the first length section, before connecting the free end of the second length section, and secondly the presence of a second actuator configured for cambering the semi-rigid structure in the second cambered position, said actuator in the form of an artificial muscle running along the second length section of the semi-rigid structure, one of the longitudinal ends of which is connected to a second anchoring point secured to the U-shaped connecting section, and the other one of the longitudinal ends is connected to the free end of the first length section by an interior tendon that runs along the second length section as far as a guide secured to the second length section, before connecting the free end of the first length section.
Figure 12:
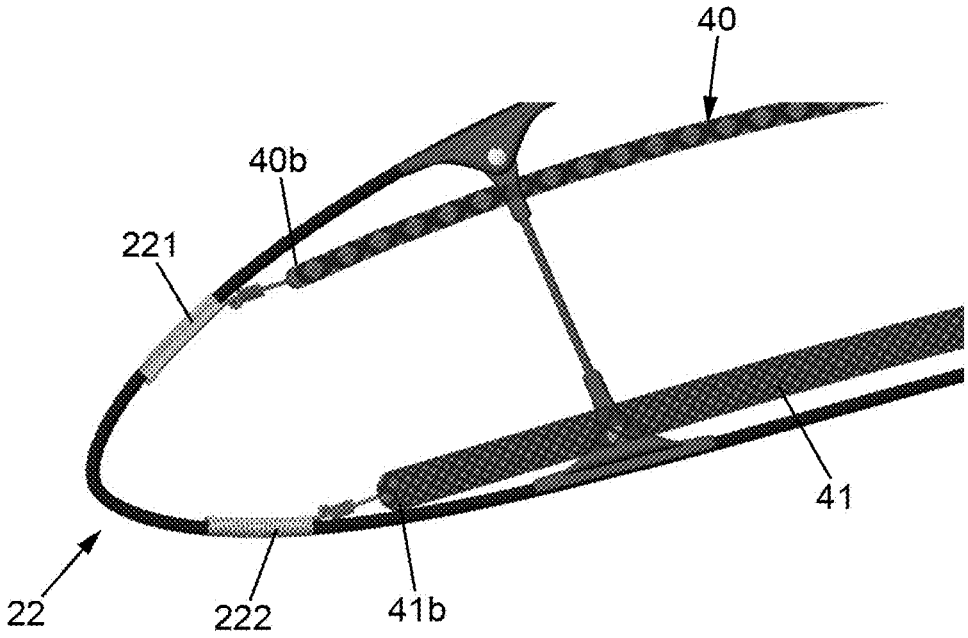
FIG. 12 is a detailed view of FIG. 11, illustrating the artificial muscle of the second actuator in the activated state, with increase in the cross-section of the muscle under the pressure of a fluid supplying a balloon of the muscle, and whereas the first actuator is in the deactivated state discharged of the pressurised fluid.

According to a second possibility (illustrated in particular in FIG. 11 or 12) the cambering device 1 comprises actuation means 4 connecting between them on the one hand at least one of the two free ends 23, 24 and on the other hand the U-shaped connecting section 22, in both cases configured for cambering the first length section and the second length section of the semi-rigid structure by tensioning one of the two free ends 23, 24 with the U-shaped connection section 22 of the semi-rigid structure 2 and generating an offset (d) between the two free ends 23, 24.

Figure 1:
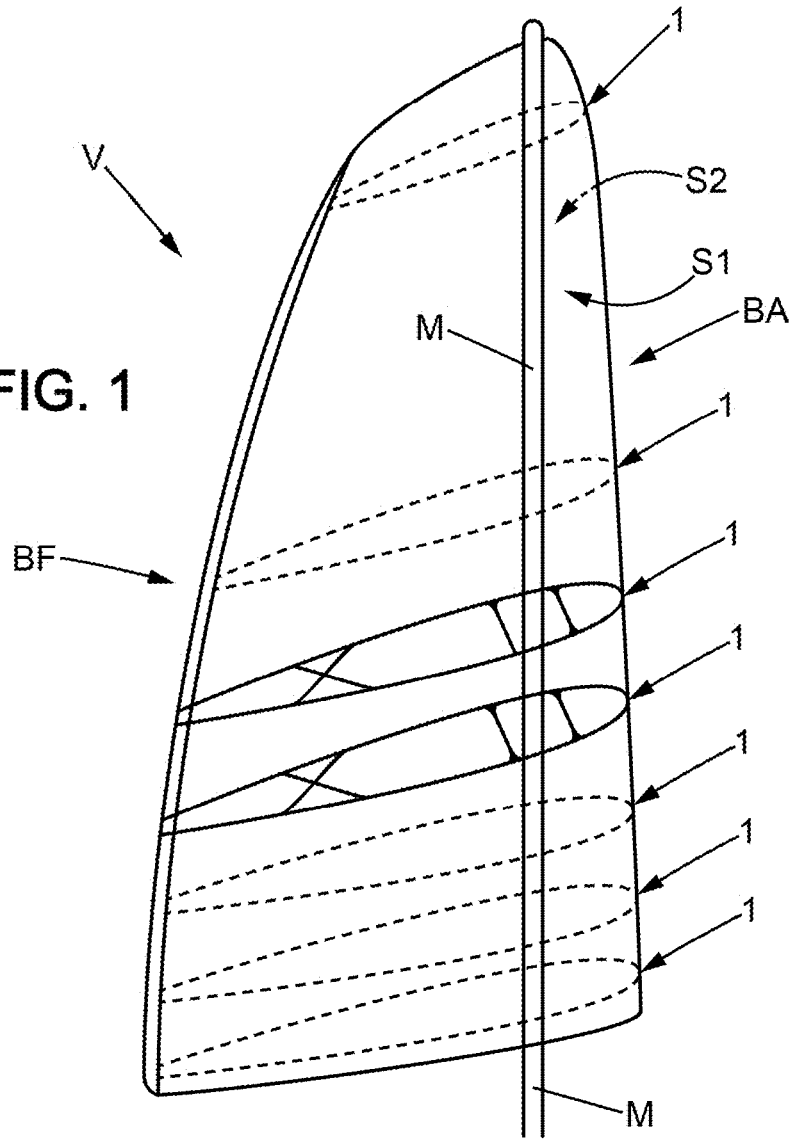
FIG. 1 shows in transparency a schematic view of rigging including a profiled sail, as well as a plurality of cambering devices in the rest position thereof, the cambering devices being configured for cambering the profiled sail, selectively in a first direction and a second direction, the profiled sail being carried by a mast, extending internally to the semi-rigid structures of the cambering devices.
Figure 1A:
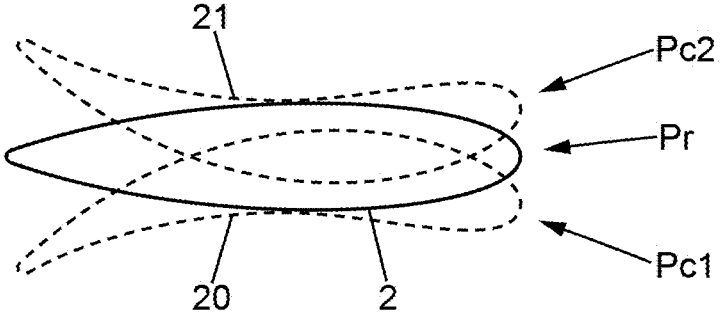
FIG. 1*a* is a schematic view of the section of the profiled sail, in solid lines, in the rest position of the cambering device, and in broken lines in two distinct cambered positions, in one direction and the other with respect to the rest position.

As illustrated by way of indication in FIG. 1, a profiled sail can be provided with a plurality of cambering devices in accordance with the present disclosure, internal to the profiled sail. The cambering devices are distributed over the height of the profiled sail. The semi-rigid structure 2 of each cambering device 1 comprises a first length section 20 secured to a first surface S1 of the profiled sail V, and the second length section 21 secured to a second surface S2 of the profiled sail V, as well as the U-shaped connecting section 22, connecting together while extending them the first length section 20 and the second length section 21 at the leading edge BA of the profiled sail, the two length sections terminating at the trailing edge BF of the sail in two free ends 23, 24.

The profiled sail, which is flexible, extends from one of the free ends 23, 24, as far as the other, passing in front of the connecting section 22; a U forming the leading edge BA. The profiled sail can be secured by two sail edges to the free ends 23, 24 via securing means, in particular by gripping the sail edges. Over the length of the two length sections, the first length section 20 and the second length section 21, removable fastenings, such as bands loops/hooks can be provided to secure the sail along the length sections 20 and 21.

Control means are configured for conjointly controlling in the same direction the various actuation means 4 of the cambering devices to camber the first surface S1 of the profiled sail and the second surface S2 of the profiled sail. For example, the cambering devices can adopt a (in particular first) cambered position for which the first length section 20 adopts a concave profile when the second length section adopts a convex profile and/or a (in particular second) cambered position wherein said second length section 21 has a concave profile when said first length section 20 has a convex profile.

The present disclosure also relates to an assembly such as rigging comprising a profiled sail V and a plurality of cambering devices 1 according to the present disclosure. The semi-rigid structure 2 of each cambering device 1 comprises the first length section 20 secured to a first surface S1 of the profiled sail V, and the second length section 21 secured to a second surface S2 of the profiled sail V, as well as the U-shaped connecting section 22, connecting together while extending them the first length section 20 and the second length section 21 at the leading edge BA of the profiled sail, the two length sections terminating at the trailing edge BF of the sail in two free ends 23, 24.

The assembly, in particular the rigging, may comprise a mast M, said profiled sail V being carried by the mast M extending internally to the semi-rigid structures 2 of the cambering devices 1, in the interspace between said first length section 20 and said second length section 21.

It should also be noted that an assembly, in particular rigging according to the present disclosure, advantageously makes it possible to haul down the sail, down the mast M, the cambering devices (with the possible exception of the one forming the boom); secured to the profiled sail, descending with the profiled sail down the mast, in particular when the halyard is released, (in the opposite direction to that of the hoisting of the profiled sail).

The present disclosure also relates to a vehicle comprising such rigging: and in particular a sailing ship or boat, or a sand yacht.

The cambered position can be adjusted during manoeuvres, for example by changing from the first cambered position Pc1 to the second cambered position Pc2 of the cambering devices (with reversed concavity) during manoeuvres involving change of tack, whether it is a case of tacking or gybing manoeuvres.

The actuators used for the actuator means may be progressive (rather than two-state) and can adopt a plurality of positions making it possible to camber the first and the second sail surface to a greater or lesser extent, in one direction or in the other. It is possible to adjust the concavity of the surface of the sail in engagement with the wind in order to maximise the force necessary for advancement of the vehicle according to the wind conditions.

The lowest cambering device may simultaneously constitute a boom, articulated on the mast, making it possible to orient the profiled sail. The boom is oriented according to the wind condition and the direction of travel of the ship.

The semi-rigid structure 2 comprising the connecting section 22 and the two length sections can consist of a semi-rigid element in a single piece, kept curved by the spacing system 3; and where applicable said flexible connecting system 5, which is described hereinafter.

For example, said element in a single piece is a rod, in particular rectilinear at rest and curved to form the semi-rigid structure 2, or a blade, in particular planar at rest and curved to form the semi-rigid structure. The rod or the blade is curved to form the first length section 20, the second length section 21 and the U-shaped connecting section 22. For example, the semi-rigid structure may consist of a curved blade for the boom of the rigging and curved rods for the semi-rigid structures of the other cambering devices (located above the boom).

Alternatively, the various sections of the semi-rigid structure 2, including the first length section 20 and the second length section 21 and the connecting section 22, can consist of a plurality of structure elements connected to one another.

According to one embodiment, the spacing system 3 comprises a first spacer 30, connecting together the first length section 20 and the second length section 21, as well as a second spacer 31, connecting together the first length section 20 and the second length section 21, for example parallel to said first spacer 30. It should be noted that the mast M of the rigging may extend in an interspace between the first spacer 30 and the second spacer 31.

The or each spacer 30, 31 of the spacing system 3 may be articulated in a pivot at its ends, respectively on the first length section 20 on a (first) axis perpendicular to the plane of the semi-rigid structure and on the second length section 21 on a (second) axis perpendicular to the plane of the semi-rigid structure. The or each spacer 30, 31 is then advantageously configured for pivoting with respect to the two length sections, the first length section 20 and the second length section 21, during the cambering and the offsetting of the free ends 23, 24; under the effect of the actuation means 4.

Figure 5:
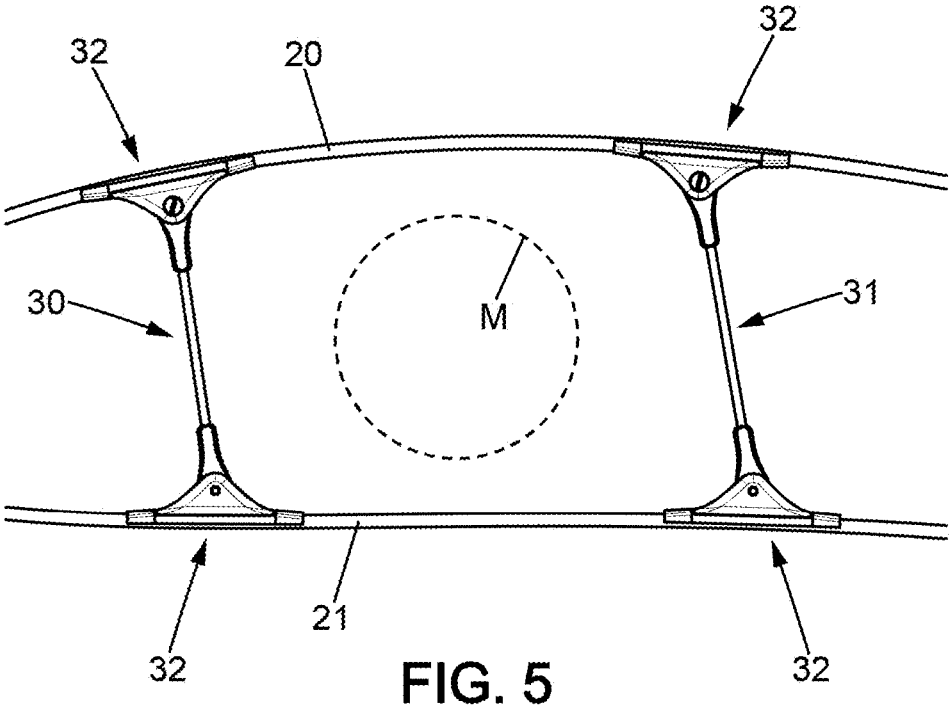
FIG. 5 is a detail view of the spacing system of the semi-rigid structure, including the first spacer and the second spacer.
Figure 6:
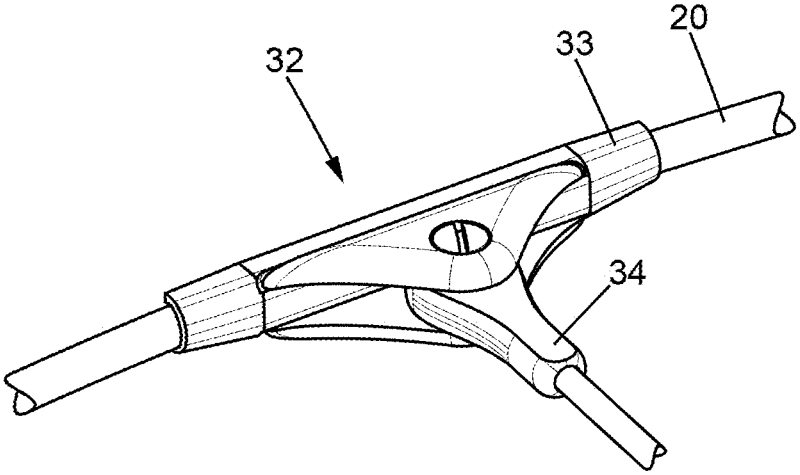
FIG. 6 is a detail view of the articulated coupling connecting each of the spacers to the first (or second) length section.
Figure 7:
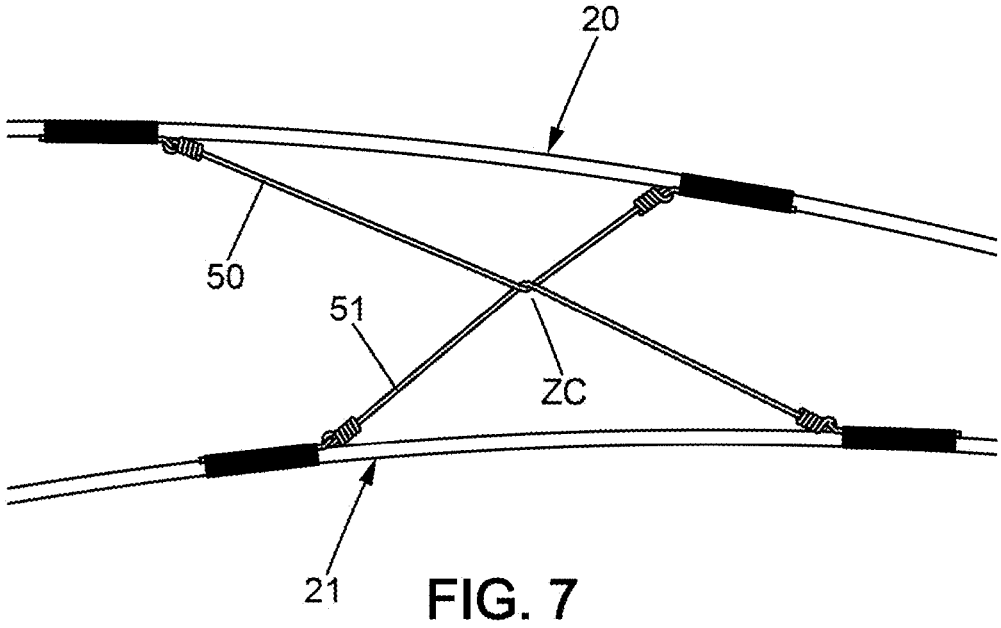
FIG. 7 is a view of the flexible connecting system, including the first flexible link secured by its two ends to the first length section, and the second flexible link secured by its two ends to the second length section, the first flexible link and the second flexible link being interlaced, working under tension to maintain a gap between the first length section and the second length section.

For this purpose, articulated couplings 32, comprising a first part 33 secured to the first length section 20 (or to the second length section 21) and a second part 34 receiving one end of the spacer 30; 31, can be used. As visible in FIGS. 5 and 6 according to one example, the second part 34 is articulated on the first part 33 on a pivot axis substantially perpendicular to the plane of the semi-rigid structure 2 to pivot with respect to the two length sections during the cambering and offsetting of the free ends 23, 24; under the effect of the actuation means 4.

According to one embodiment, the spacing system comprises a telescopic spacer 35, connecting in particular the first length section 20 and the second length section 21, configured for deploying and retracting on a limited travel. This telescopic spacer 35 works in compression in a retracted position P1 of least separation, and works in tension in a separated deployed position P2.

Figure 10:
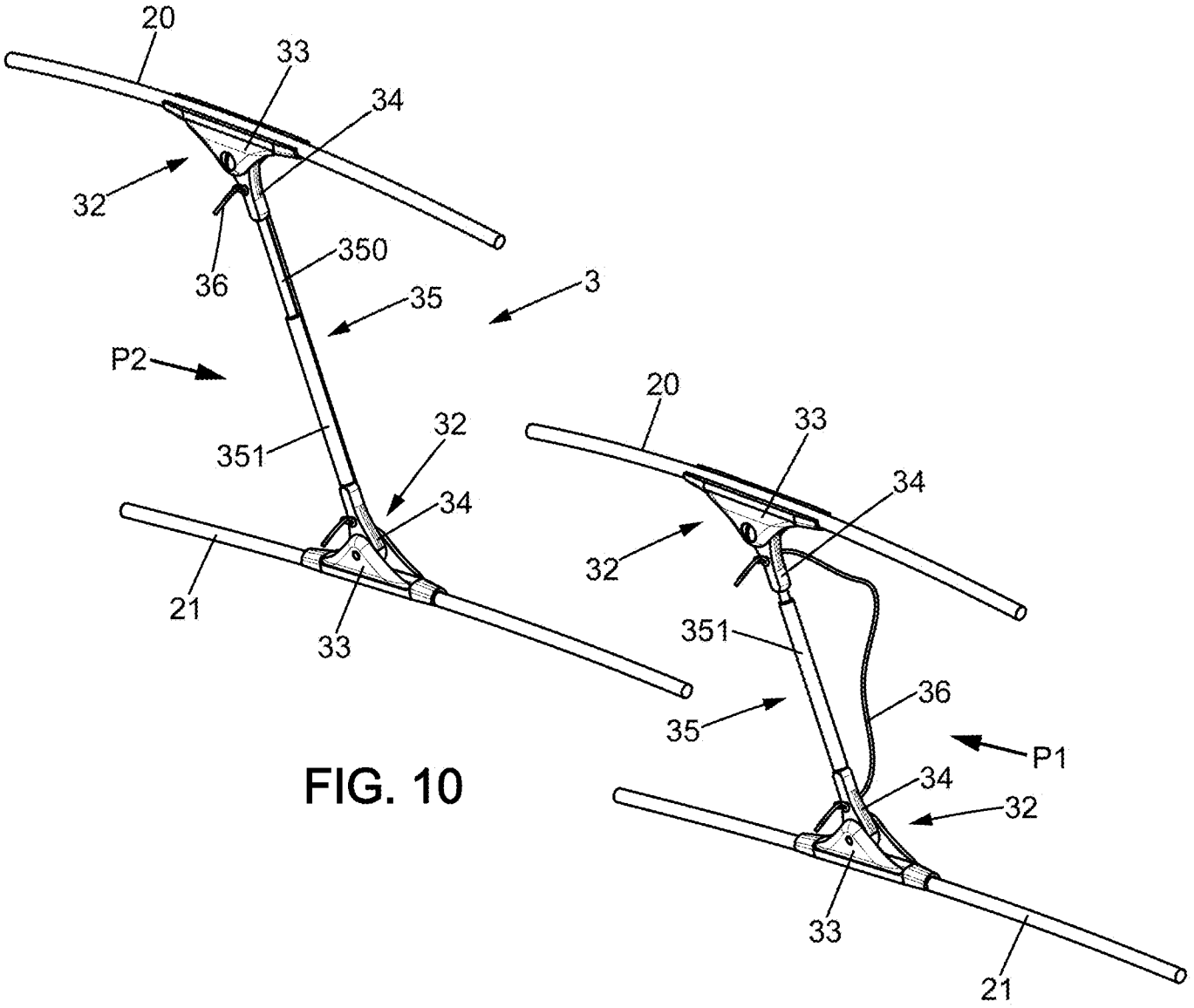
FIG. 10 are two detail views of a spacing system comprising a telescopic spacer, respectively in a deployed position of the telescopic spacer then configured for working under tension (left-hand view) and in a retracted position then configured for working in compression (right-hand view).

Such a telescopic spacer is illustrated in the views in FIG. 10, by way of non-limitative example, respectively in its deployed position P2 (on the left) and in its retracted position P1 (on the right). This telescopic spacer may comprise two telescopic sections, namely a first telescopic section 350 and a second telescopic section 351, configured for sliding one in the other to pass from the retracted position P1 to the deployed position P2 of the telescopic spacer 35.

The end of travel in the retracted position P1 (work in compression) can be obtained by putting the sections 350 and 351 in abutment, for example with the coupling 32. The end of travel in the deployed position P2 (work in extension) can be obtained by a flexible link 36, connecting the two telescopic sections 350, 351 of the spacer, configured in the tension state in the deployed position P2, and in the relaxed state in a retracted position P1 of the telescopic spacer 35. For example, the flexible link 36 connects the two parts 34 of two couplings 32, receiving respectively an end of the telescopic first section 350 and an end of a second telescopic section.

Such a telescopic spacer can be used at the head of the sail (namely in proximity to the leading edge) and in particular when the reduction in the profile chord involves a thickness less than the maximum diameter of the mast.

The cambering device 1 can have a flexible connecting system 5, joining together the first length section 20 and the second length section 21. This flexible connecting system is disposed in an intermediate position of the structure between the two free ends 23, 24 and said spacing system 3; said flexible connecting system 5 working in tension to maintain between them a separation between the two length sections.

It should also be noted that the spacing system 3 and the flexible connecting system 5 both extend internally to the semi-rigid structure 2, in the interspace between the first length section 20 and the second length section 21, and preferably entirely in the plane of the semi-rigid structure 2.

The flexible connecting system 5; includes two flexible links, including a first flexible link 50 secured by its two ends to the first length section 20, and a second flexible link 51 secured by its two ends to the second length section 21. The two flexible links, the first flexible link 50 and the second flexible link 51, are interlaced at a contact zone Zc between the two flexible links 50, 51. The contact zone Zc between the two flexible links is configured for sliding along the flexible links 50, 51 during the cambering and offsetting of the free ends 23, 24; under the effect of the actuation means 4.

Thus, and whether it be the spacing system, when the or each spacer is articulated at its ends on the two length sections (the first length section 20 or the second length section 21), or the flexible connecting system with the possibility of sliding of the contact zone between the two flexible links, these two systems favour offsetting between free ends 23, 24, when the actuation means 4 are activated.

Figure 2:
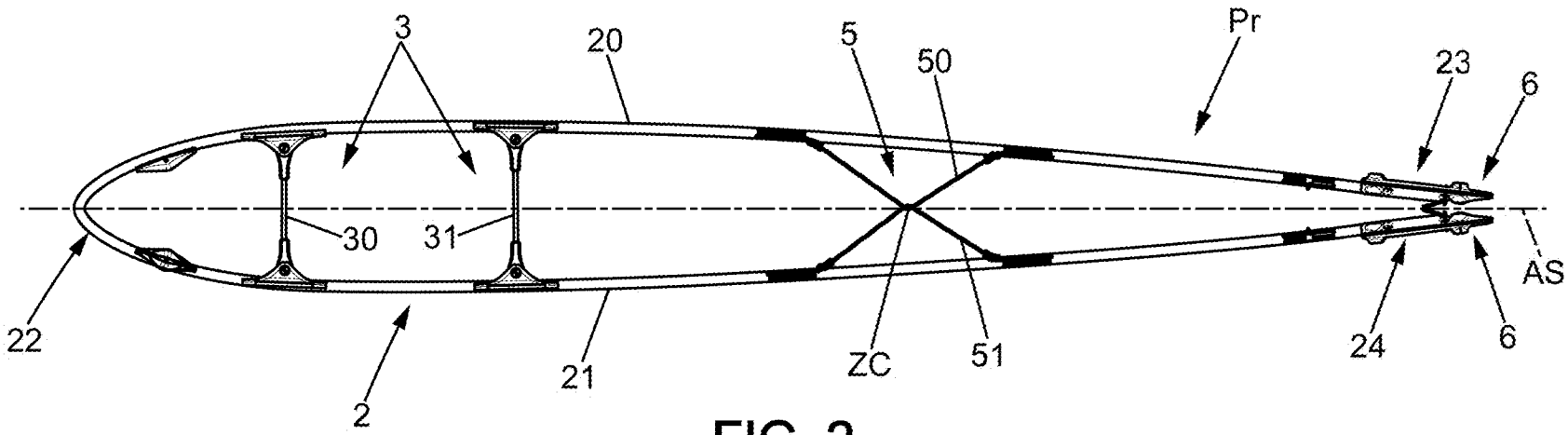
FIG. 2 shows an embodiment of the cambering device (flexible tendon and pneumatic muscles of the actuation means not illustrated) including the semi-rigid structure, in its rest position, formed by a curved rod forming the connecting section, the first length section and the second length section, as well as first angular member and a second angular member, both each comprising a pulley, including the spacing system, the first spacer and the second spacer, the flexible connecting system, including the first flexible link and the second flexible link interlaced with each other, and attachment means for the edge of each profiled sail, at each free end of the semi-rigid structure, as well as two guides secured to the first and second length section in proximity to the free ends, providing guidance of the flexible tendons.
Figure 3:
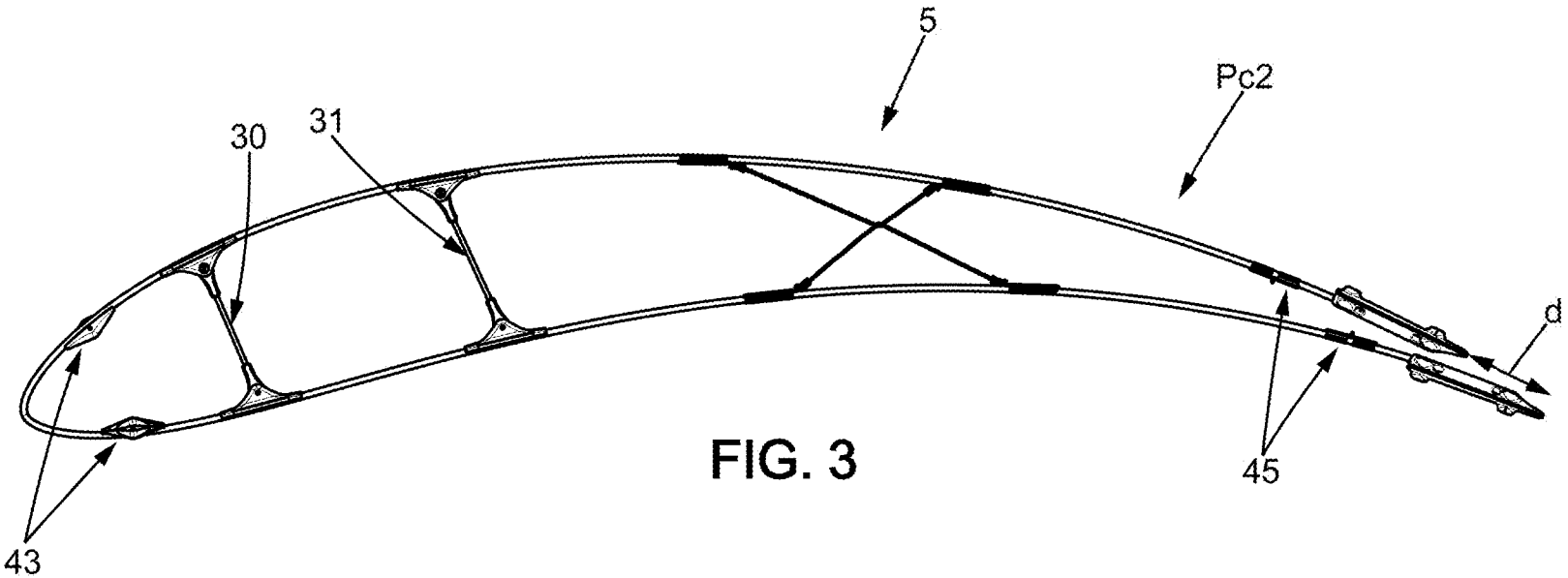
FIG. 3 is a view of the cambering device in a cambered position of the elastic semi-rigid structure under the action of actuation means (not illustrated).

The semi-rigid structure 2 may have a profile having a symmetry plane, in a rest position Pr of the semi-rigid structure 2 wherein the first length section 20 and the second length section 21 have a convex profile. As can be seen in FIG. 2, the symmetry plane AS of the semi-rigid structure 2 in its rest position extends in the direction between the leading edge BA and the trailing edge BF, perpendicular to the plane of the semi-rigid structure 2 containing the first length section 20, the second length section 21 and the U-shaped connecting section 22.

In the rest position Pr of the semi-rigid structure, it will be noted that the first spacer 30 and the second space 31 respectively extend substantially perpendicular to the symmetry plane AS.

In at least one cambered position Pc1 and/or Pc2 of the semi-rigid structure 2 under the action of the actuation means 4, said first length section 20 has a concave profile when said second length section 21 has a convex profile, or said second length section 21 has a concave profile when said first length section 20 has a convex profile.

According to one embodiment, the actuation means 4 are configured to camber the semi-rigid structure selectively:

- in a first cambered position Pc1 wherein said first length section 20 has a concave profile when said second length section 21 has a convex profile,
- in a second cambered position Pc2 wherein said second length section 21 has a concave profile when said first length section 20 has a convex profile.

According to one embodiment (in particular illustrated in FIG. 4 or 13 and 14), the actuation means 4 may comprise at least one actuator 40, 41, extending along one of the two length sections of the structure, the first length section 20 (or second length section 21), connected to the free end 23 or 24 of the length section by a flexible exterior tendon 42, external to the semi-rigid structure 2, via at least one angular member 43 secured to the U-shaped connecting section, and connected to the free end 24, 23 of the other length section by an interior tendon 44 that runs along the length section as far as a guide 45, before connecting said free end 24 or 23 of the other length section, the second length section 21 or first length section 20.

Said at least one angular member 43 is located alongside the symmetry plane (rather than on the latter) of the semi-rigid structure 2, the profile of the length section (the first length section or second length section) of which it is wished to change from the convex profile to the concave profile.

When the actuation means make it possible to obtain the two cambered positions Pc1 and Pc2, two angular members disposed on either side of the central plane make it possible respectively to camber the semi-rigid structure in these two cambered positions:

- a first angular member 431, secured to the connecting section 22, disposed alongside the first length section 20 (with respect to the symmetry plane) is acted on to allow the change of profile of the first length section 20 (and therefore the first surface S1 of the profiled sail) from the convex profile in the rest position Pr of the semi-rigid structure 2 to said first cambered position Pc1 where the first length section 20 adopts the concave profile;
- a second angular member 432, secured to the connecting section; disposed alongside the second length section 21 (with respect to the symmetry plane), is acted on to allow the change of profile of the second length section 10 (and therefore the second surface S2 of the profiled sail) from the convex profile in the rest position Pr of the semi-rigid structure 2 to said second cambered position Pc2 where the second length section 21 adopts the concave profile.

The actuator 40; 41 is configured to retract in an active state and to pull on the two free ends 23, 24 connected respectively by the exterior tendon 42 and the interior tendon 44, on the one hand, and on the angular member 43 of the connecting section 22 on the other hand, until the offset d is created, the free end connected by the interior tendon 44 advancing towards the leading edge BA with respect to the free end connected by the exterior tendon 42, causing the cambering of the semi-rigid structure, the acted-on exterior tendon 42 moving away from the length section, the first length section (or second length section immediately adjacent to the exterior tendon 42), which then adopts a concave profile, and whereas the other length section, the second length section or first length section, adopts a convex profile.

The offsetting of the free ends 23, 24 makes it possible to initiate the change of profile of the length section—the first length section 20 or the second length section—from the convex profile in the rest position Pr of the semi-rigid structure 2, and to the concave profile in said cambered position, in particular first cambered position Pc1 or second cambered position Pc2.

The change of profile of the first length section 20 is initiated, in particular from the convex profile in the rest position Pr to a concave profile in the first cambered position Pc1, by the offsetting of the free end 24 of the second connecting section 21 towards the leading edge BA with respect to the free end 23 of the first connecting section 20.

Consequently, the concavity of the first length section 20 can be accentuated by the actuation means 4, by traction of the exterior tendon 42 connecting the first angular member 431 and the free end 23 (such as the chord of an arc).

The change of profile of the second length section 21 is initiated, in particular from the convex profile in the rest position Pr to a concave profile in the first cambered position Pc2, by offsetting the free end 23 of the first length section 20 towards the leading edge BA with respect to the free end 24 of the second length section 21].

Consequently, the concavity of the second length section 21 can be accentuated by the actuation means 4, by the traction of the exterior tendon 42 connecting the second angular member 432 and free end 24 (such as the chord of an arc).

Exterior tendon 42 means the fact that the flexible tendon passes outside of the semi-rigid structure 2, and of the sail between the angular member 43—the first angular member 431 or second angular member 432—and respectively the free end, respectively the free end of the first length section 20 and the end 24 of the second length section 21, and even if the flexible tendon is partially internal to the structure between the angular member and the actuator (first actuator 40 or second actuator 41).

According to one embodiment (illustrated in FIG. 4) the exterior tendon 42 between the angular member (first angular member 431 or second angular member 432) and the free end (free end 23 or 24) is again external to the profiled sail, in particular external to the first sail surface S1 between the first angular member 431 and the free end 23 and external to the second sail surface S2 between the second angular member 432 and the free end 24. For this purpose, the first sail surface S1 (or respectively the second sail surface S2) has a passage opening for the exterior tendon 42 at the first angular member 431 (respectively of the second angular member 432).

According to another embodiment (illustrated in FIGS. 13 and 14) the exterior tendon 42 between the angular member (first angular member 431 or second angular member 432) and the free end (free end 23 or 24) is again external to the profiled sail, in particular external to the first sail surface S1 between the first angular member 431 and a second guide 231, and external to the second sail surface S2 between the second angular member 432 and a second guide 241. For this purpose, the first sail surface S1 (on respectively the second sail surface S2) has a first passage opening for the exterior tendon 42 at the first angular member 431 (or respectively at the second angular member 432) and a second passage opening for the exterior tendon 42 at the second guide 231 (or respectively second guide 241).

According to this embodiment (of FIGS. 13 and 14), the exterior tendon 42 extends entirely to the structure, namely:

along the first length section between the second guide 231 secured to the first length section 20 and the free end 23 of the first length section 20 along the second length section 21 between the second guide 241 secured to the second length section 21 and the free end 24 of the second length section 21.

As can be seen, the second guide 231 (or 241) can include two rollers, with parallel rotation axes, juxtaposed. The exterior tendon 44 is guided by the two rollers while passing between the two rollers.

When the first sail surface S1 adopts a concave surface under the action of the first length section 20, the exterior tendon 42 also moves away from this first profiled sail surface S1.

When the second sail surface S2 adopts a concave surface under the action of the second length section 21, the exterior tendon 42 also moves away from this first profiled sail surface S2.

According to one embodiment (illustrated in FIG. 4 or 13 and 14), the actuation means comprise:

a first actuator 40 configured for cambering the semi-rigid structure in said first cambered position Pc1, extending along the first length section 20 connected to the free end 23 of the first length section by a flexible exterior tendon 42, to the semi-rigid structure 42 via a first angular member 431 secured to the U-shaped connecting section 22, and by an interior tendon 44 that runs along the first length section 20 as far as a guide 45 of said first length section 20 before connecting the free end 24 of said second length section 21, the first actuator 40 being configured to retract and pull on the two free ends 23, 24 connected by an exterior tendon 42 and the interior tendon 44, on the one hand, and on the first angular member 431 on the other hand, until the offset d is created, the end 24 connected by the interior tendon 44 advancing towards the leading edge BA with respect to the free end 23 connected by the exterior tendon 42, causing the cambering of the semi-rigid structure, the acted-on exterior tendon 42 separating from the first length section 20, which adopts a concave profile, the second length section 21 adopting a convex profile in said first cambered position Pc1, a second actuator 41 configured for cambering the semi-rigid structure in said second cambered position Pc2, extending along the second length section 21 connected to the free end 24 of the second length section by a flexible exterior tendon 42 to the semi-rigid structure 2, via a second angular member 432 secured to the U-shaped connecting section 22, and by an exterior tendon 44 that runs along the second length section 21 as far as a guide 45 of said second length section 21 before connecting the free end 23 of said first length section 20, the second actuator 41 being configured for retracting and pulling on the two free ends 23, 24 connected by the exterior tendon 42 and the interior tendon 44, on the one hand, and on the second angular member 432 on the other hand, until the offset d is created, the free end 23 connected by the interior tendon 44 advancing towards the leading edge BA with respect to the free end 24 connected by the exterior tendon 42 while causing the cambering of the semi-rigid structure 2, the acted-on exterior tendon 42 moving away from the second length section 21, which adopts a concave profile, whereas said first length section 20 adopts a convex profile in said second cambered position Pc2.

According to another embodiment (illustrated in FIGS. 11 and 12) the actuation means 4 comprise:

a first actuator 40 for cambering the semi-rigid structure in said first cambered position Pc1, internal to the semi-rigid structure, extending along the first length section 20, one 40*a* of the two longitudinal ends 40*a*, 40*b* of which is connected to the free end 24 of the second length section 21 by an interior tendon 44 that runs from one 40*a* of the two longitudinal ends of the first actuator 40 as far as a guide 45 secured to the first length section 40, before connecting the free end 2 of the second length section 41, while the other longitudinal end 40*b* of the actuator 40 is secured to a first anchoring point 221 of the U-shaped connection, the first actuator 40 being configured, in an active state, for retracting and pulling on the free end 24 connected by the interior tendon 44 on the one hand, and on the first anchoring point 221 on the other hand, until the offset d is created, the end 24 connected by the interior tendon 44 advancing towards the leading edge BA with respect to the other free end 23 while causing the cambering of the semi-rigid structure, the first length section 20 adopting a concave profile, the second length section 21 adopting a convex profile in said first cambered position Pc1, a second actuator 41 for cambering the semi-rigid structure in said first cambered position Pc2, internal to the semi-rigid structure, extending along the second length section 21, one 41*a* of the two longitudinal ends 41*a*, 41*b* of which is connected to the free end 23 of the first length section 21 by the interior tendon 44 that runs from one 41*a* of the two longitudinal ends of the second actuator 41 as far as a guide 45 secured to the second length section 40, before connecting the free end 23 of the first length section 40, while the other longitudinal end 41*b* of the actuator 40 is secured to a second anchoring point 222 of the second U-shaped connecting section 22 the second actuator 40 being configured, in an active state, for retracting and pulling on the free end 23 connected by the interior tendon 44 on the one hand, and on the second anchoring point 222 on the other hand, until the offset d is created, the free end 23 connected by the interior tendon 44 advancing towards the leading edge BA with respect to the other free end 24 while causing the cambering of the semi-rigid structure, the second length section 21 adopting a concave profile, the first length section 20 adopting a convex profile in said second cambered position Pc2.

The first anchoring point 221 of the first actuator 40 is located, with respect to the symmetry plane AS of the semi-rigid structure then in a rest position Pr alongside the first actuator 40. The second anchoring point 222 of the first actuator 40 is located, with respect to the symmetry plane AS of the semi-rigid structure then in a rest position Pr alongside the second actuator 41.

According to one embodiment, the cambering device comprising a control means configured for selectively:

activating the first actuator 40 while keeping the second actuator 41 non-activated to cause said first cambered position Pc1, activating the second actuator 41 while keeping the first actuator 40 non-activated to cause said second cambered position Pc2.

These control means may be external to the semi-rigid structure of the cambering device.

The control means can also make it possible to adjust the setting of the depth of the concavity when the actuator, first actuator 40 and/or second actuator 41, is a progressive actuator.

Said at least one actuator, where applicable first actuator 40 and second actuator 41, may be an actuator that retracts when supplied with fluid, such as an artificial muscle, in particular a pneumatic muscle.

Such an actuator has an envelope internally receiving a balloon supplied with or discharged of fluid. The flexible envelope retracts in length when its cross-section increases under the increase of the balloon supplied with fluid (contraction of the muscle), and deploys in length when its cross-section decreases when the balloon is discharged of fluid (reduction in the pressure of the fluid). The retraction of the actuator can be progressive by controlling the quantity of the fluid fed into the balloon.

Such pneumatic actuation systems are usually referred to as "artificial muscles" consisting of inflatable bolsters inserted in protective braids forming an envelope, such that the artificial muscle contracts or expands when its internal fluid pressure increases or decreases. Such artificial muscles are for example described by B. Tondu and P. Lopez in "Report of the Academy of Science", vol. 320, pp 105-114, 1995.

Such an artificial muscle is illustrated schematically in its deployed position in FIG. 17*a* and in its retracted position in FIG. 17*b*, as well as in a cross-sectional view in FIG. 17*c*.

When the balloon B is supplied with pressurised fluid (for example air) the cross-section of the balloon increases, which causes an increase in the cross-section of the envelope Ev in the form of a braid in FIG. 17*a*.

Under the effect of the increase in the cross-section of the envelope, the braiding of the envelope generates a force providing the retraction of the artificial muscle, by bringing together the longitudinal ends 40*a*, 40*b* or 41*a*, 41*b*.

Such an actuator has the advantage of:

not requiring electrification of the profiled sail, being a flexible component; little liable to be aggressive for the surfaces of the profiled sail, avoiding risks of tearing.

This flexible actuator can extend:

where it is the first actuator 40, along the first length section 20, between the two spacers, first spacer 30 and second spacer 31, where it is the second actuator 41, along the second length section 21, between the two spacers, first spacer 30 and second spacer 31.

In particular, when the two spacers receive between them the mast M, such a position of the flexible actuators is advantageous in that these actuators, which are flexible, procure, apart from their first actuator function, a function of bolster protecting the semi-rigid structure. For example, and during changes of tack, tacking or gybing, the internal mast may change bearing from the first length section 20 against the second length section 21 (or vice-versa), during changes in orientation and profile of the sail. The flexible actuators then advantageously damp and protect the length sections from shocks resulting from the changes in bearing.

Figure 8:
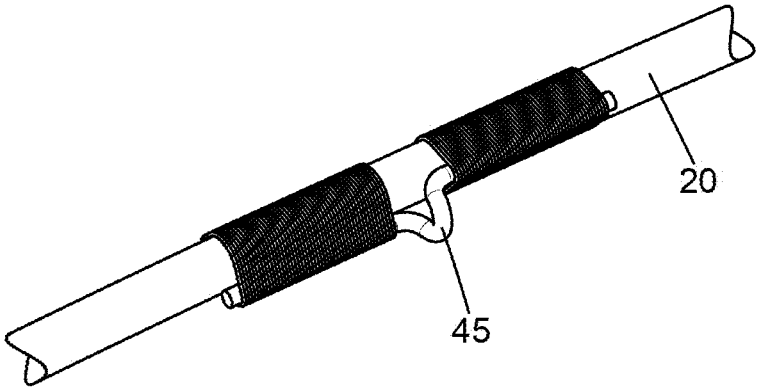
FIG. 8 is a detail view of the guide, secured to the first length section (or the second length section) and providing guidance of the interior tension in proximity to the free end.

An example of a guide 45 is illustrated in FIG. 8; the actuator—first actuator 40 or second actuator 41—is secured firstly at one of its longitudinal ends to the external tendon 42, which extends between the actuator and the angular member 43, first angular member 431 or second angular member 432—along the length section 20 or 21, before passing to the outside; and secondly, at the other of its longitudinal ends to the interior tendon, which runs as far as the guide 45 attached on the same side of the symmetry plane as the angular member—first angular member or second angular member—cooperating with the actuator, before connecting the free end of the length section, of the length section located opposite to the actuator, namely second length section or first length section.

In FIG. 8, the guide 45 consists of a simple loop formed by a buckle.

Figure 9:
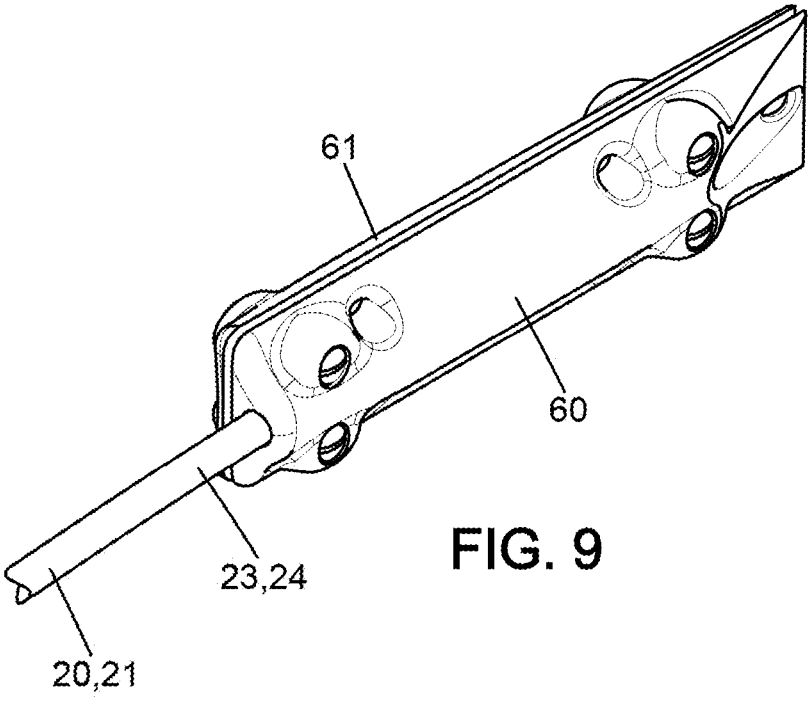
FIG. 9 is a detail view of means for firmly securing the free end of the first length section (or of the second length section) comprising the first support secured to the first length section (or to the second length section) having a bearing surface, a second support comprising a counter-bearing surface, the means being configured for gripping the edge of the profiled sail between the bearing surface and the counter-bearing surface, under the effect of clamping means of the securing means.

Finally, FIG. 9 illustrates an example of means 6 for attaching two edges of the profiled sail V, at the trailing edge BF.

These attachment means 6 may comprise, for each free end 23, 34, a first support 60 secured to the free end 23 or 24, having a bearing surface, and a second support 61 removably mounted, having a counter-bearing surface, as well as means for clamping between the first support 60 and second support 61 configured for gripping a sail edge between the bearing surface and the counter-bearing surface of the first support and second support. The clamping means may be screw systems.

According to one embodiment, the profiled sail is configured for being:

hoisted up the mast M, into the high position of the profiled sail, the cambering devices 1 in positions separated from each other, and as illustrated by way of example in FIG. 15, hauled down the mast M into the low position of the profiled sail, the cambering devices 1 in positions close to each other, and as illustrated by way of example in FIG. 16.

The artificial muscles of the actuators 40, 41 of the plurality of cambering devices 1 can be supplied with fluid by one or more flexible elastic pipes AL1, AL2, AL3, conformed in the form of a coil, extending in the direction of the height of the mast M.

Advantageously, the flexible elastic pipe or pipes are configured for deploying by separation of the turns of the coil in the high position of the profiled sail, and for retracting by bringing together the turns of the coil, under the elasticity of the coil in the low position of the profiled sail.

The artificial muscles of the actuators 40, 41 are supplied with pressurised fluid by the elastic pipe or pipes AL1, AL2, AL3 by a reserve of pressurised fluid, preferably housed inside the mast M at the foot of the mast.

Industrial Application and Advantages

The present technical solutions can be applied in particular in the maritime field of sail boats, as an improved rigging solution.

The cambering devices being composed of an elastically deformable semi-rigid structure, or even where applicable flexible actuator or actuators in the form of artificial muscles, it is particularly suitable for a marine environment, where the rigging elements may suffer impacts, under the action of the wind or unexpected manoeuvres.

The actuators—in particular first actuator or second actuator—being integrated actually within the semi-rigid structure, and in particular in the plane of the semi-rigid structure, the length of the flexible connections—internal and external tendon—is limited, ensuring the cambering of the structure. The precision of the control is improved in that the use is avoided of actuators offset at a distance from the cambering systems, which requires control links of substantial length, which impairs the precision of the control, and because of their elongation under stress, and which moreover represent a risk of a significant risk of tangling with the other parts of the rigging.

Another advantage of providing the actuator or actuators actually within the structure according to the present disclosure, contained in the plane of the semi-rigid structure, is that the forces generated by the actuation means remain themselves contained in this plane, and contrary to the teaching of the document WO 2017/202858 A1, for which the control link extends in its visible part in the plane of the structure of the cambering device, then substantially in its non-visible part perpendicularly along the mast as far as an actuator, positioned at the foot of the mast; according to such a prior art, the actuation means generate forces not exclusively contained in the plane of the semi-rigid structure, and in particular with a direction substantially perpendicular to the plane.

The fact that the forces of the actuation means are contained in the plane of the semi-rigid structure, according to the present disclosure, makes it possible, if necessary, to simplify the structure of the cambering device, by limiting the use of semi-rigid component or components to what is strictly necessary, and as illustrated at the third embodiment 18*a* to 18*d*.

Advantageously, and in general terms, the spacing system 3 with its spacer or spacers 30; 31 can be replaced by a simple flexible connection 7, joining by its two ends the first length section 20 and the second length section 21, working solely in tension to limit the separation between the first length section 20 and the second length section 21.

As can be seen in FIGS. 18*a* to 18*d*, the mast M is arranged internally to the structure in the interspace defined between the flexible connection referenced 7 and the U-shaped connecting section 22.

The flexible connecting system 5 with its first and second flexible links 50, 51 may be kept, or even replaced by a simple flexible connection 8, joining by its two ends the first length section 20 and the second length section 21.

Simplifying the structure of the cambering device by removing the spacing system, which may be damaged in the case of repeated impacts against the mast M, makes it possible not only to reduce the cost thereof but also makes it possible to improve the reliability of the rigging when subjected to unforeseen wind that may cause such repeated impacts between the spacers 30, 31 and the mast M.

Notably, the present disclosure also finds an application in wind turbines. The present disclosure also relates to a wind turbine comprising a profiled sail provided with one or more cambering devices (1) according to the present disclosure.

LIST OF REFERENCE SIGNS

1: Cambering device
2: Semi-rigid structure
20, 21: First length section and second length section
22: U-shaped connecting section
23, 34: Free ends
231, 241: Second guides (for the interior tendon)
3: Spacing system
30, 31: First spacer and second spacer
32: Coupling
33, 34: First part and second part (coupling)
35: Telescopic spacer
350, 351: First telescopic section and second telescopic section
36: Flexible link (with end-of-travel function in extension)
4: Actuation means
40,41: Actuators, first and second
42: Exterior tendon(s)
43: Angular members, in particular first angular member 431 and second angular member 432
44: Tendon, interior, flexible
45: Guides (where applicable first for the interior tendon)
5: Flexible connecting system
50: First flexible link
51: Second flexible link
6: Attachment means (sail)
AS: Symmetry plane of the semi-rigid structure (FIG. 2)
B: Balloon (artificial muscle)
Envelope (in particular braid) BA. Leading edge
BF: Trailing edge
V: Profiled sail
d: offset between the two free ends
ZC: Contact zone between the two flexible links
Pr: Rest position
Pc1: First cambering position
Pc2: Second cambering position
P1, P2: Retracted and deployed positions telescopic spacer)

The invention claimed is:

1. Cambering device for a profiled sail comprising:

an elastically deformable semi-rigid structure, including:

first and second length sections, extending alongside, forming respectively a first length section secured to a first surface of the profiled sail, and a second length section secured to a second surface of the profiled sail, a U-shaped connecting section, interconnecting and extending the first length section and the second length section at a leading edge of the profiled sail, the first length section and the second length section terminating at a trailing edge of the profiled sail in two free ends, actuation means connecting together firstly the two free ends of the elastically deformable semi-rigid structure, or at least one of the two free ends, and secondly the U-shaped connecting section, configured for cambering the first length section and the second length section of the elastically deformable semi-rigid structure by a tensioning of the free ends with the U-shaped connecting section of the elastically deformable semi-rigid structure, or at least by a tensioning of one of the two free ends with the U-shaped connecting section of the elastically deformable semi-rigid structure, and generating an offset between the two free ends, and wherein the actuation means comprise at least one actuator, having two longitudinal ends, said actuator being retractable when activated with bringing together said two longitudinal ends, said at least one actuator extending along one of the first length section and the second length section of the elastically deformable semi-rigid structure, first length section or second length section, said actuator being internal to the elastically deformable semi-rigid structure, contained in a plane of the elastically deformable semi-rigid structure, and wherein a first one of said two longitudinal ends of said at least one actuator is connected to one of the two free ends by an interior tendon while a second one of said two longitudinal ends of said at least one actuator is connected either to an anchoring point secured to the U-shaped connecting section, or to the first one of the two free ends via an angular member secured to the U-shaped connecting section by an exterior tendon, a flexible exterior tension passing outside the elastically deformable semi-rigid structure, and to the profiled sail between the angular member and respectively one of the two free ends.

2. The cambering device according to claim 1, wherein said actuator, which is flexible, is an artificial muscle, contracting when supplied under pressure with a fluid, and relaxing when the pressure of the fluid decreases, said artificial muscle having an envelope internally receiving a balloon supplied with or discharged of the fluid, the flexible envelope being configured to retract in length when a cross-section thereof increases under increase of the balloon supplied with fluid, and deploying in length when said cross-section decreases when the balloon is discharged of fluid.

3. The cambering device according to claim 1, wherein said device comprises a spacing system, comprising at least one spacer connecting together the first length section and the second length section, configured for working in compression and in tension, for maintaining a separation between the first length section and the second length section.

4. The cambering device according to claim 1, wherein the elastically deformable semi-rigid structure has a profile having a symmetry plane, in a rest position of the elastically deformable semi-rigid structure wherein the first length section and the second length section have a convex profile, and wherein in at least one cambered position of the elastically deformable semi-rigid structure under action of the actuation means, said first length section has a concave profile when said second length section has a convex profile, or said second length section has a concave profile when said length section has a convex profile.

5. The cambering device according to claim 1, wherein the actuation means are configured for cambering the elastically deformable semi-rigid structure selectively:

in a first cambered position wherein said first length section has a concave profile when said second length section has a convex profile, in a second cambered position wherein said second length section has a concave profile when said first length section has a convex profile.

6. The cambering device according to claim 5, wherein said at least one actuator of the actuation means comprises:

a first actuator configured for cambering the elastically deformable semi-rigid structure in said first cambered position, extending along the first length section, internal to the elastically deformable semi-rigid structure, secured at the first one of its longitudinal ends to the exterior tendon, connected firstly to the free end of the first length section by said exterior tendon, which is flexible, and which is external to the elastically deformable semi-rigid structure, via a first angular member secured to the U-shaped connecting section, the flexible exterior tendon passing outside the elastically deformable semi-rigid structure, and to the profiled sail between the first angular member and respectively the free end of the first length section, the flexible exterior tendon being internal to the elastically deformable semi-rigid structure between the first angular member and said first actuator, the first actuator being secured at the second one of its longitudinal ends to the interior tendon, said first actuator connected; firstly; to the free end of said second length section by said interior tendon, which runs along the first length section as far as a guide secured to said first length section before connecting said free end of said second length section, the first actuator being configured, in an active state, for retracting and pulling on the two free ends connected by the exterior tendon and the interior tendon, and to the first angular member, until the offset is created, an end connected by the interior tendon advancing towards a leading edge with respect to the free end connected by the exterior tendon while causing cambering of the elastically deformable semi-rigid structure, the exterior tendon separating from the first length and, which adopts a concave profile, the second length section adopting a convex profile in said first cambered position, a second actuator configured for cambering the elastically deformable semi-rigid structure in said second cambered position, extending along the second length section internal to the elastically deformable semi-rigid structure, secured at one of said first and second longitudinal ends to an exterior tendon, connected firstly to the free end of the second length section by a flexible exterior tendon that is external to the elastically deformable semi-rigid structure, via a second angular member secured to the U-shaped connecting section, the flexible exterior tendon passing outside the elastically deformable semi-rigid structure, and to the profiled sail between the second angular member and respectively the free end of the second length section, the flexible exterior tendon being internal to the elastically deformable semi-rigid structure between the second angular member and said second actuator, the second actuator being secured at the second of its longitudinal ends to the interior tendon, said second actuator connected firstly to the free end of said first length section by said interior tendon that runs along the second length section as far as a guide secured to said second length section before connecting the free end of said first length section, the second actuator being configured, in an active state, for retracting and pulling on the two free ends connected by the exterior tendon and the interior tendon, and to the second angular member, until the offset is created, the free end connected by the interior tendon advancing towards leading edge with respect to the free end connected by the exterior tendon while causing cambering of the elastically deformable semi-rigid structure, the exterior tendon separating from the second length section, which adopts a concave profile, whereas said first length section adopts a convex profile in said second cambered position.

7. The cambering device according to claim 5, wherein said at least one actuator of the actuation means comprises:

a first actuator for cambering the elastically deformable semi-rigid position, internal to the elastically deformable semi-rigid structure, extending along the first length section, one of the first and second longitudinal ends of which is structure in said first cambered connected to the free end of the second length section by the interior tendon, which runs from one of the first and second longitudinal ends of the first actuator as far as a guide secured to the first length section, before connecting the free end of the second length section, while the second longitudinal end of the actuator is attached to a first anchoring point of the U-shaped section, the first actuator being configured, in an active state, for retracting and pulling on the free end connected by the interior tendon, and on the first anchoring point, until the offset is created, an end connected by the interior tendon advancing towards a leading edge with respect to the second free end while causing cambering of the elastically deformable semi-rigid structure, the first length section adopting a concave profile, the second length section adopting a convex profile in said first cambered position, a second actuator for cambering the elastically deformable semi-rigid structure in said first cambered position, internal to the elastically deformable semi-rigid structure, extending along the second length section, one of the first and second longitudinal ends of which is connected to the free end of the first length section by the interior tendon that runs from one of the first and second longitudinal ends of the second actuator as far as a guide secured to the second length section, before connecting the free end of the first length section, while the second longitudinal end of the actuator is attached to a second anchoring point of the U-shaped section the second actuator being configured, in an active state, for retracting and pulling on the free end connected by the interior tendon, and on the second anchoring point, until the offset is created, an end connected by the interior tendon advancing towards a leading edge with respect to the second free end while causing cambering of the elastically deformable semi-rigid structure, the second length section adopting a concave profile, the first length section adopting a convex profile in said second cambered position.

8. The cambering device according to claim 6, comprising a control means configured for selectively:

activating the first actuator while keeping the second actuator non-activated to cause said first cambered position, activating the second actuator while keeping the first actuator non-activated to cause said second cambered position.

9. The cambering device according wherein the exterior tendon extends from said to claim 6, angular member, the first angular member or second angular outside the elastically deformable member, semi-rigid structure, as far as said free end.

10. The cambering device according to claim 9, wherein the exterior tendon extends between the angular member, the first angular member or second angular member, and in the direction of said free end connected by the exterior tendon, outside the elastically deformable semi-rigid structure as far as a second guide carrying rollers secured to the length section of the structure, the exterior tendon being located internally to the elastically deformable semi-rigid structure between the second guide and said free end.

11. The cambering device according to claim 3, having a flexible connecting system, joining together the first length section and the second length section, in an intermediate position between the two free ends and said spacing system; said connecting system, which is flexible, working in tension to maintain a separation between the first and second length sections.

12. The cambering device according to claim 11, wherein the flexible connecting system; includes two flexible links, including a first flexible link secured at two ends thereof to the first length section, and a second flexible link secured at two ends thereof to the second length section, the two flexible links, the first flexible link and second flexible link, being interlaced at a contact zone between the two flexible links, the contact zone between the two flexible links being configured for sliding along the flexible links during cambering and the offsetting of the free ends; under the effect of the actuation means.

13. The cambering device according to claim 3, the spacing system comprises a first spacer, connecting together the first length section and the second length section, as well as a second spacer, connecting together the first length section and the second length section, parallel to said first spacer.

14. The cambering device according to claim 3, wherein the or each spacer of the spacing system is articulated in a pivot at ends thereof, respectively on the first length section on an axis perpendicular to the plane of the elastically deformable semi-rigid structure and on the second length section on an axis perpendicular to the plane of the elastically deformable semi-rigid structure, the or each spacer being configured for pivoting with respect to the first and second length sections, the first length section and second length section, during cambering and the offsetting of the free ends; under the effect of the actuation means.

15. The cambering device according to claim 14, comprising articulated couplings, comprising a first part secured to the first length section or to the second length section, and a second part receiving an end of the spacer, the second part being articulated on the first part on a pivot axis substantially perpendicular to the plane of the elastically deformable semi-rigid structure for pivoting with respect to the first and second length sections during cambering and the offsetting of the free ends; under the effect of the actuation means.

16. The cambering device according to claim 3, wherein the spacing system comprises a telescopic spacer, connecting the first length section and the second length section, configured for deploying and retracting on a limited travel and working in compression in a retracted position of least separation, and working in tension in a separated deployed position.

17. The cambering device according to claim 1, wherein elastically deformable semi-rigid structure comprising the connecting section and the first and second length sections, including the first length section and the second length section, consists of a semi-rigid element in a single piece, kept curved by the spacing system; or alternatively, by one or more flexible connections, joining the first length section and the second length section.

18. The cambering device according to claim 1, comprising means for attaching two edges of the profiled sail, at a trailing edge, including for each free end, a first support secured to the free end, having a bearing surface, and a second support mounted removably, and has a counter-bearing surface, as well as clamping means between the first support and the second support configured for gripping a sail edge between the bearing surface and the counter-bearing surface of the first support and second support.

19. Assembly comprising a profiled sail and a plurality of cambering devices according to claim 1 and wherein the elastically deformable semi-rigid structure of each cambering device comprises a first length section secured to a first surface of the profiled sail, and the second length section secured to a second surface of the profiled sail, as well as the U-shaped connecting section, connecting together while extending the first length section and the second length section at a leading edge of the profiled sail, the first and second length sections terminating at a trailing edge of the profiled sail in two free ends, and wherein the actuation means comprising said at least one actuator, having the first and second longitudinal ends, said actuator being retractable when activated, said at least actuator extending along one of the first and second length sections of the elastically deformable semi-rigid structure, the first length section or second length section, said actuator being internal to the elastically deformable semi-rigid structure, contained in a plane of the elastically deformable semi-rigid structure.

20. The assembly Assembly according to claim 19, wherein said actuator, which is flexible, is said artificial muscle, contracting when supplied under pressure by a fluid, and relaxing when the pressure of the fluid decreases, said artificial muscle having an envelope receiving internally a balloon supplied with or discharged of the fluid, the flexible envelope retracting in length when a cross-section thereof increases under increase of the balloon supplied with fluid, and deploys in length when a cross-section thereof decreases when the balloon is discharged of the fluid.

21. The assembly according to claim 19, said profiled sail is carried by a mast extending internally to semi-rigid structures of the cambering devices, in the interspace between said first length section and said second length section.

22. Assembly comprising a profiled sail and a plurality of the cambering devices of claim 13, wherein the elastically deformable semi-rigid structure of each cambering device comprises a first length section secured to a first surface of the profiled sail, and the second length section secured to a second surface of the profiled sail, as well as the U-shaped connecting section, connecting together while extending the first length section and the second length section at a leading edge of the profiled sail, the first and second length sections terminating at trailing edge of the profiled sail in two free ends, and wherein the actuation means comprising said at least one actuator, having the first and second longitudinal ends, said actuator being retractable when activated, said at least actuator extending along one of the first and second length sections of the elastically deformable semi-rigid structure, the first length section or second length section, said actuator being internal to the elastically deformable semi-rigid structure, contained in a plane of the elastically deformable semi-rigid structure, and wherein said profiled sail is carried by a mast extending internally to semi-rigid structures of the cambering devices, in the interspace between said first length section and said second length section, the spacing system comprising the first spacer, connecting together the first length section and the second length section, as well as the second spacer, connecting together the first length section and the second length section, parallel to said first spacer, and wherein said mast extends internally to each semi-rigid structure at the interspace defined by the first spacer and the second spacer of the spacing system.

23. Assembly comprising a profiled sail and a plurality of cambering devices according to claim 6, wherein the elastically deformable semi-rigid structure of each cambering device comprises a first length section secured to a first surface of the profiled sail, and the second length section secured to a second surface of the profiled sail, as well as the U-shaped connecting section, connecting together while extending the first length section and the second length section at the leading edge of the profiled sail, the first and second length sections terminating at the trailing edge of the profiled sail in two free ends, and wherein the actuation means comprising said at least one actuator, having the first and second longitudinal ends, said actuator being retractable when activated, said at least actuator extending along one of the first and second length sections of the elastically deformable semi-rigid structure, the first length section or second length section, said actuator being internal to the elastically deformable semi-rigid structure, contained in a plane of the elastically deformable semi-rigid structure, wherein said actuator, which is flexible, is said artificial muscle, contracting when supplied under pressure by a fluid, and relaxing when the pressure of the fluid decreases, said artificial muscle having an envelope receiving internally a balloon supplied with or discharged of the fluid, the flexible envelope retracting in length when its cross-section increases under the increase of the balloon supplied with fluid, and deploys in length when its cross-section decreases when the balloon is discharged of the fluid, comprising:

said first actuator that extends the first length section, between the two spacers, the first spacer and second spacer, said second actuator that extends along the second length section, between the two spacers, the first spacer and second spacer and wherein the first flexible actuator and the second flexible actuator are configured for damping and protecting the first and second length sections from the impacts resulting from the changes in bearing during changes of tack, tacking or gybing, the internal mast configured for changing bearing during the first length section against the second length section or vice-versa from the second length section against the first length section during changes in orientation and profile of the sail.

24. The assembly according to claim 20, wherein the profiled sail is configured for being:

hoisted up the mast, into the high position of the profiled sail, the cambering devices in positions separated from each other, hauled down the mast into the low position of the profiled sail, the cambering devices in positions close to each other and wherein the artificial muscles of the actuators of the plurality of cambering devices are supplied with fluid by one or more flexible elastic pipes, conformed in a coil, extending in the direction of the height of the mast, the flexible elastic pipe or pipes being configured for deploying by separation of the turns of the coil in the high position of the profiled sail, and for retracting by bringing together of the turns of the coil under the elasticity of the coil, in the low position of the profiled sail.

25. The assembly according to claim 24, wherein the artificial muscles of the actuators are supplied with pressurised fluid by the elastic pipe or pipes by a reserve of pressurised fluid, housed inside the mast at the foot of the mast.

26. Sail vehicle comprising an assembly according to claim 19.

* * * * *